US011723820B2

(12) United States Patent
Paul et al.

(10) Patent No.: US 11,723,820 B2
(45) Date of Patent: Aug. 15, 2023

(54) PATIENT SUPPORT APPARATUS

(71) Applicant: Stryker Corporation, Kalamazoo, MI (US)

(72) Inventors: Anish Paul, Kalamazoo, MI (US); Mehmet Zihni Gürlek, Kayseri (TR); Mustafa Karasu, Kayseri (TR); William D. Childs, Plainwell, MI (US); Steven L. Birman, Kalamazoo, MI (US); Murat Serkan Kantarci, Kayseri (TR); Berkay Güncan, Mersin (TR)

(73) Assignee: Stryker Corporation, Kalamazoo, MI (US)

( * ) Notice: Subject to any disclaimer, the term of this patent is extended or adjusted under 35 U.S.C. 154(b) by 186 days.

(21) Appl. No.: 17/213,528

(22) Filed: Mar. 26, 2021

(65) Prior Publication Data

US 2021/0298971 A1 Sep. 30, 2021

Related U.S. Application Data

(60) Provisional application No. 63/001,301, filed on Mar. 28, 2020.

(51) Int. Cl.
*A61G 7/015* (2006.01)
*A61G 7/05* (2006.01)

(52) U.S. Cl.
CPC ..... *A61G 7/015* (2013.01); *A61G 7/0503* (2013.01); *A61G 7/0506* (2013.01); *A61G 2200/32* (2013.01); *A61G 2203/70* (2013.01)

(58) Field of Classification Search
CPC .... A61G 7/015; A61G 7/0528; A61G 7/0506; A61G 1/0281; A61G 2203/70; A61G 2200/32; A47C 20/04; A47C 19/025; A47C 19/005
See application file for complete search history.

(56) References Cited

U.S. PATENT DOCUMENTS 1,356,467 A * 10/1920 Payne ..... A61G 7/015 5/618
4,421,358 A 12/1983 Lehnen
5,692,256 A 12/1997 Kramer et al.
5,996,150 A * 12/1999 Blevins ..... A61G 7/1046 177/144

(Continued)

*Primary Examiner* — Robert G Santos
*Assistant Examiner* — Adam C Ortiz
(74) *Attorney, Agent, or Firm* — Howard & Howard Attorneys PLLC

(57) ABSTRACT

A patient support apparatus including a base frame arranged for movement about a floor surface. The base frame defines a foot end and a head end, and includes first and second longitudinal rails extending between the foot end and the head end with a plurality of lateral receivers formed in each of the first and second longitudinal rails. A patient support deck provides support to a patient, and includes a fowler deck section and a base deck section. The fowler deck section is coupled to the base frame for pivoting movement relative to the first and second longitudinal rails. The base deck section is attached to the first and second longitudinal rails, and includes a plurality of lateral braces having notched ends shaped to be inserted into a respective one the plurality of lateral receivers formed in the first and second longitudinal rails to assemble the patient support apparatus.

16 Claims, 26 Drawing Sheets

(56) References Cited

U.S. PATENT DOCUMENTS

| | | | | |
|---|---|---|---|---|
| 6,109,685 | A | 8/2000 | Lindsey et al. | |
| 6,499,162 | B1 | 12/2002 | Lu | |
| 7,533,429 | B2 | 5/2009 | Menkedick et al. | |
| 2002/0178501 | A1* | 12/2002 | Cook | A47C 19/045 5/611 |
| 2011/0203050 | A1* | 8/2011 | Rogers | A47C 19/005 5/285 |
| 2016/0206486 | A1* | 7/2016 | Eskridge, III | A47C 20/041 |

* cited by examiner

PATIENT SUPPORT APPARATUS

CROSS-REFERENCE TO RELATED APPLICATION

This application claims priority to and all the benefits of U.S. Provisional Patent Application No. 63/001,301, filed on Mar. 28, 2020, the disclosure of which is hereby incorporated by reference in its entirety.

BACKGROUND

Patient support apparatuses, such as hospital beds, stretchers, cots, tables, wheelchairs, and chairs, are used to help caregivers facilitate care of patients in a health care setting. Those having ordinary skill in the art will appreciate that health care facilities are generally equipped to handle a specific maximum quantity of patients, based such as on the number of rooms in their facilities (e.g., floor space), the number of hospital beds, the number of caregivers and staff on call, and the like. Thus, increases in the quantity of patients admitted to a health care facility, and/or increases in the duration of patient admissions, can place significant strain on available resources.

In certain situations, there exists a potential for hospitals, emergency rooms, triage sites, municipalities, and health care facilities in general to experience a sudden, rapid increase in patient volume and/or patient admission duration. Here, health care facilities are generally prepared to reallocate existing resources to compensate, such as by increasing the number of patients in certain areas (e.g., two hospital beds in rooms that previously had only one hospital bed), designating certain areas for specific types of patients, and the like.

Depending on how wide-spread the situation is, or how fast it progresses, health care facilities may become strained beyond capacity, and may need to purchase additional equipment and/or utilize off-site facilities to handle rapid increases in patient volume. It will be appreciated that the logistics surrounding this type of rapid expansion and resource allocation can be extremely complex. For example, manufacturing and assembling conventional hospital beds and other types of patient support apparatuses can be difficult to rapidly scale-up for a number of reasons. Furthermore, these types of patient support apparatuses typically employ large assemblies of components that undergo various manufacturing and assembly steps, using various types of machinery to, for example, stamp, cut, grind, bend, weld, form, and assemble different materials. Thus, because of how these types of conventional patient support apparatuses are manufactured, they tend to be shipped fully assembled or close to fully assembled. It will be appreciated that this necessarily limits the number of patient support apparatuses that can be shipped on a single carrier (e.g., in an enclosed semi-truck trailer) because of the volume footprint required for each patient support apparatus.

While conventional patient support apparatuses have generally performed well for their intended purpose, there remains a need in the art for a patient support apparatus that allows caregivers and emergency responders to move, position, and provide care to patients, and that can be manufactured, shipped, and assembled in an efficient and cost-effective manner, rapidly and at high volume.

It will be appreciated that the drawings may depict certain components and/or structural features in phantom, or with certain components removed, for illustrative purposes. Furthermore, it will be appreciated that exploded views may depict certain components (e.g., fasteners such as nuts, bolts, pins, washers, bushings, clevis pins, cotter pins, rue clips, and the like) with incomplete or partial explosion spacing (e.g., moved together with another component or components) for illustrative purposes.

DETAILED DESCRIPTION OF THE EMBODIMENTS

Referring to FIGS. 1A-4, a patient support apparatus 30 is shown for supporting a patient in a health care setting. The patient support apparatus 30 illustrated throughout the drawings is realized as a hospital bed; more specifically, an emergency relief bed which, as will be appreciated from the subsequent description below, can be manufactured, shipped, assembled, and utilized quickly, efficiently, cost-effectively, and at high volume. However, it will be appreciated that aspects of the present disclosure may be utilized in connection with other types of patient support apparatuses, such as cots, stretchers, gurneys, wheelchairs, tables, and the like. Other configurations are contemplated.

Figure 3:
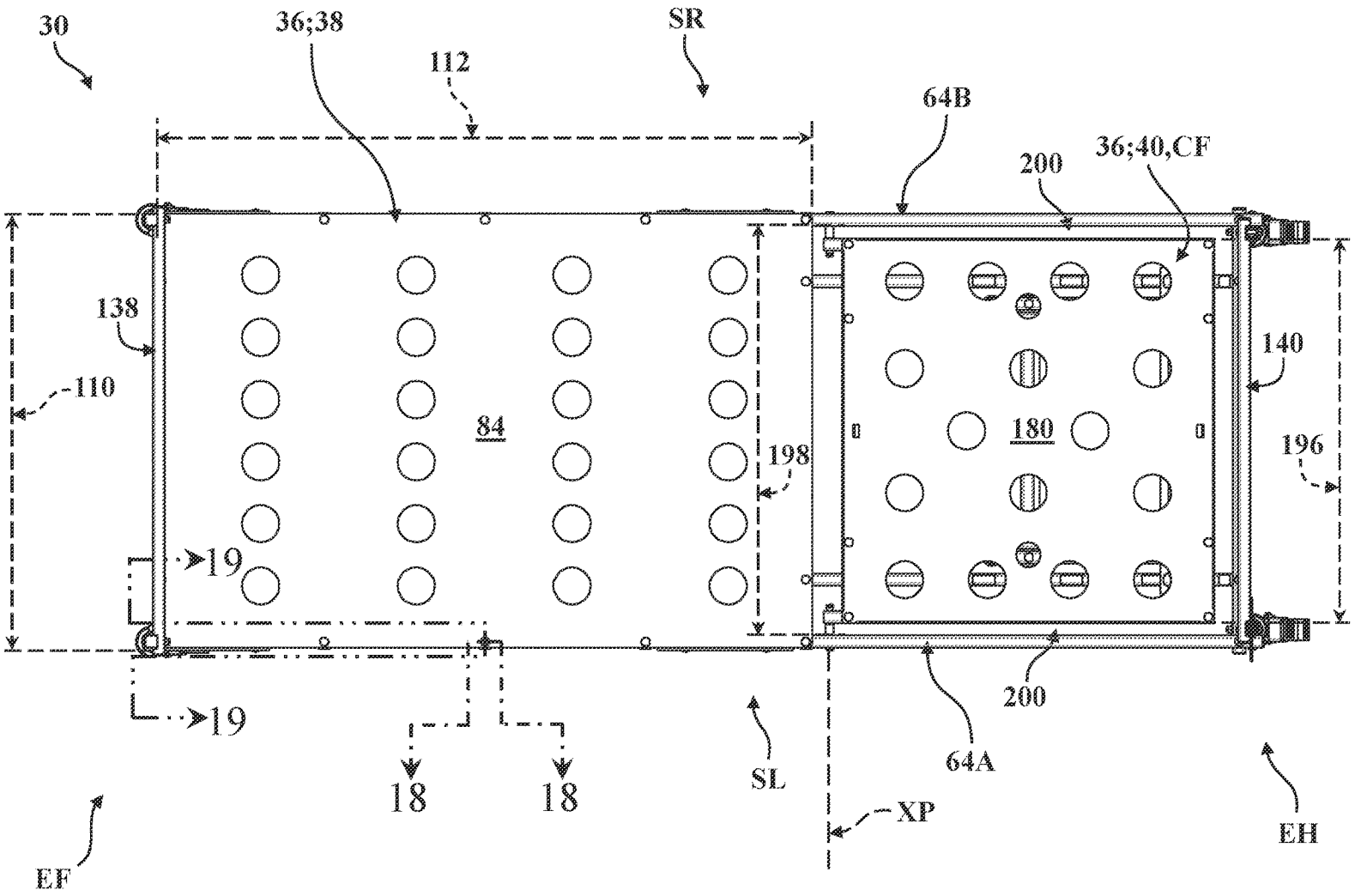
FIG. 3 is a top-side plan view of the patient support apparatus of FIGS. 1A-2 depicted without the mattress, and shown with the fowler deck section arranged in the flat configuration.
Figure 4:
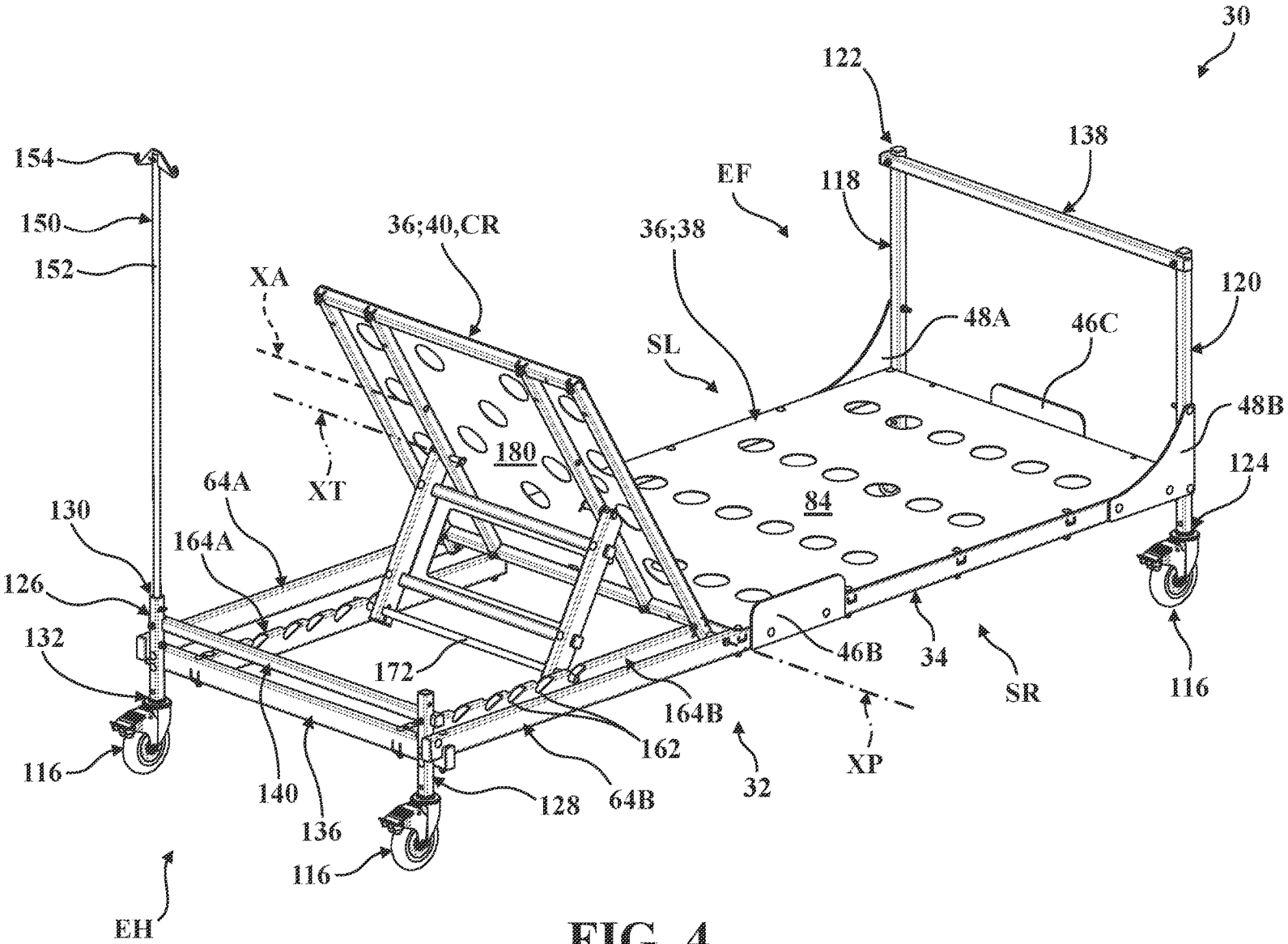
FIG. 4 is a perspective view of the patient support apparatus of FIGS. 1A-3 depicted without the mattress, and shown with the fowler deck section arranged in the raised configuration.

The patient support apparatus 30 has a support structure 32 which includes a base frame 34 arranged for movement about a floor surface FS, and a patient support deck 36 to provide support to a patient. The base frame 34 generally defines a head end EH and a foot end EF of the patient support apparatus 30, as well as a first lateral side SL and a second lateral side SR. As is best depicted in FIGS. 3-4, the patient support deck 36 includes a base deck section 38 operatively attached to the base frame 34, and a fowler deck section 40 coupled to the base frame 34 for pivoting movement between a plurality of patient support configurations, including a raised configuration CR (see FIG. 1A), a flat configuration CF (see FIG. 1C), and one or more intermediate configurations CI (see FIG. 1B) between the raised configuration CR and the flat configuration CF. As used herein, "flat configuration CF" refers to an arrangement of the fowler deck section 40 that is generally coplanar with the base deck section 38, while "raised configuration CR" refers to an arrangement of the fowler deck section 40 disposed at a "maximum" angle relative to the base deck section 38 (e.g., raised approximately 60-degrees from the flat configuration CF), and "intermediate configuration CI" refers to an arrangement of the fowler deck section 40 disposed at an angle relative to the base deck section 38 that is between the raised configuration CR and the flat configuration CF (e.g., raised approximately 30-degrees from the flat configuration CF). In the representative embodiments illustrated herein, multiple intermediate configurations CI may be utilized, including the 30-degree intermediate configuration CI illustrated in FIG. 1B. However, it will be appreciated that more or fewer intermediate configurations CI may be utilized, and that the intermediate configuration(s) CI can be defined or set in a number of different ways. It is also contemplated that the patient support apparatus 30 could be configured to employ only the raised configuration CR and the flat configuration CF (e.g., with no discrete intermediate configurations CI), such as where the raised configuration CR is defined as being at or above a vascular patient position (e.g., raised 30-degrees, raised 45-degrees, and the like). Other configurations are contemplated.

Figure 1A:
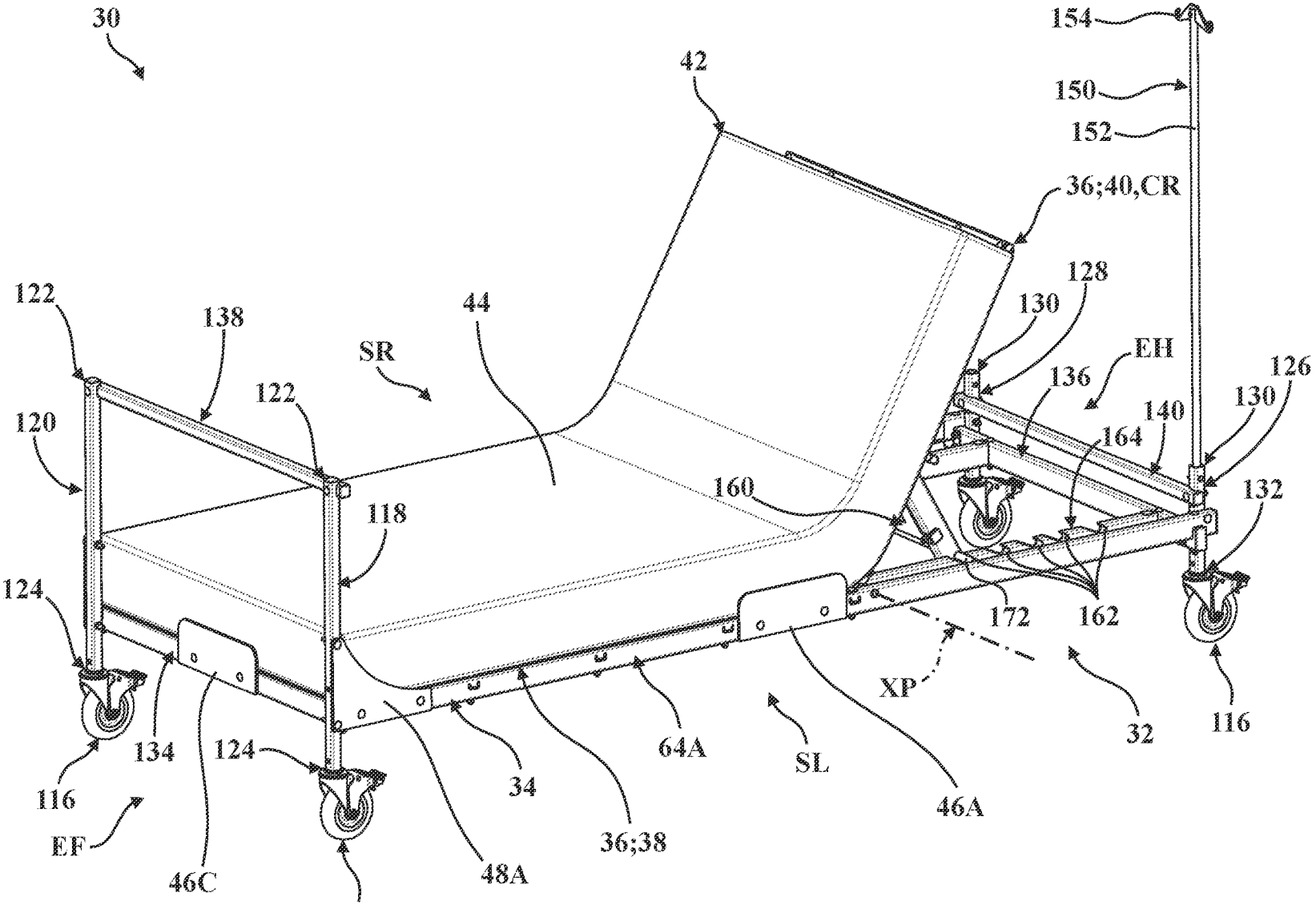
FIG. 1A is a perspective view of a patient support apparatus, according to embodiments of the present disclosure, shown having a base frame and a patient support deck supporting a mattress, the patient support deck having a base deck section and a fowler deck section shown arranged in a raised configuration.
Figure 1B:
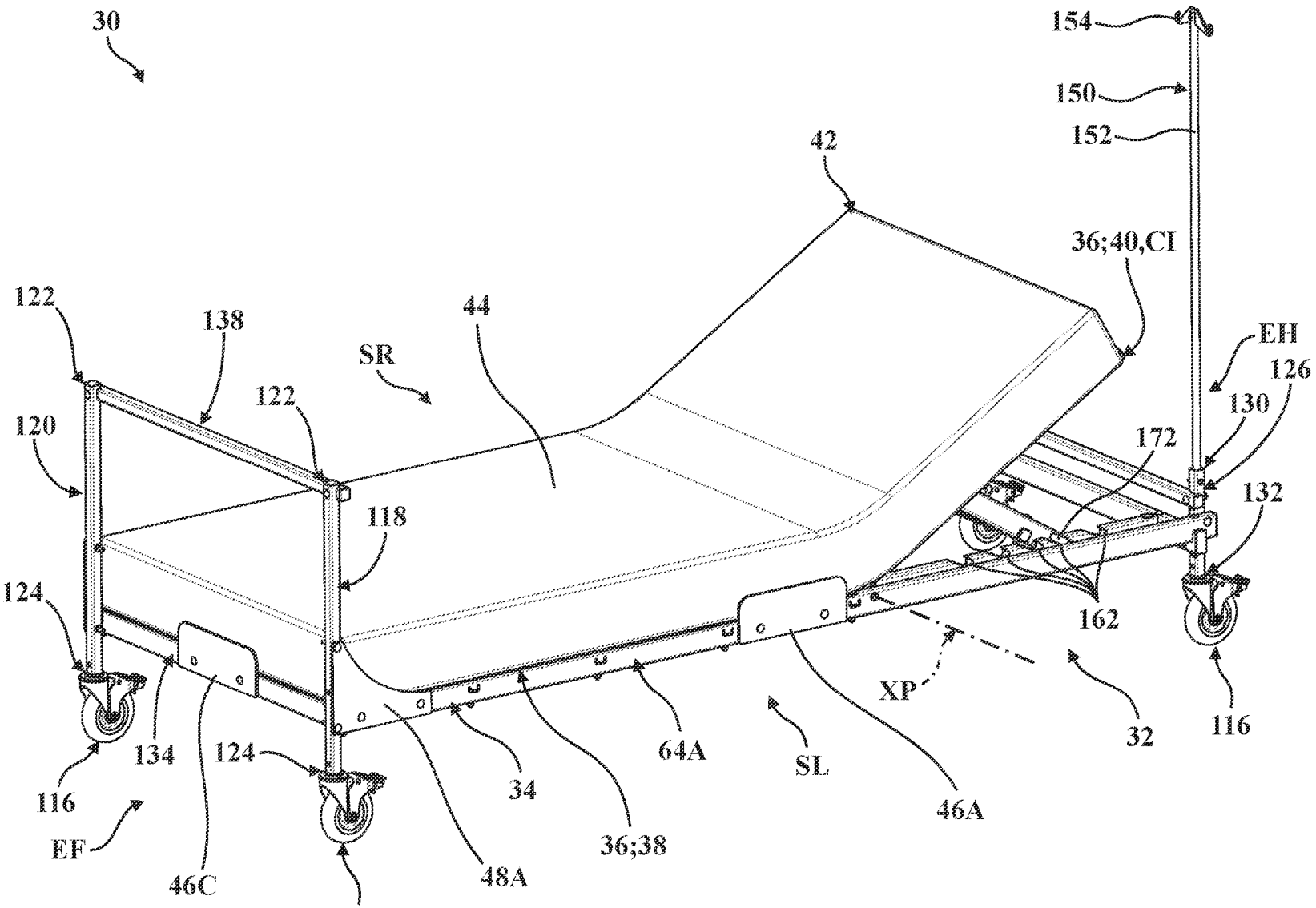
FIG. 1B is another perspective view of the patient support apparatus of FIG. 1A, shown with the fowler deck section arranged in an intermediate configuration.
Figure 1C:
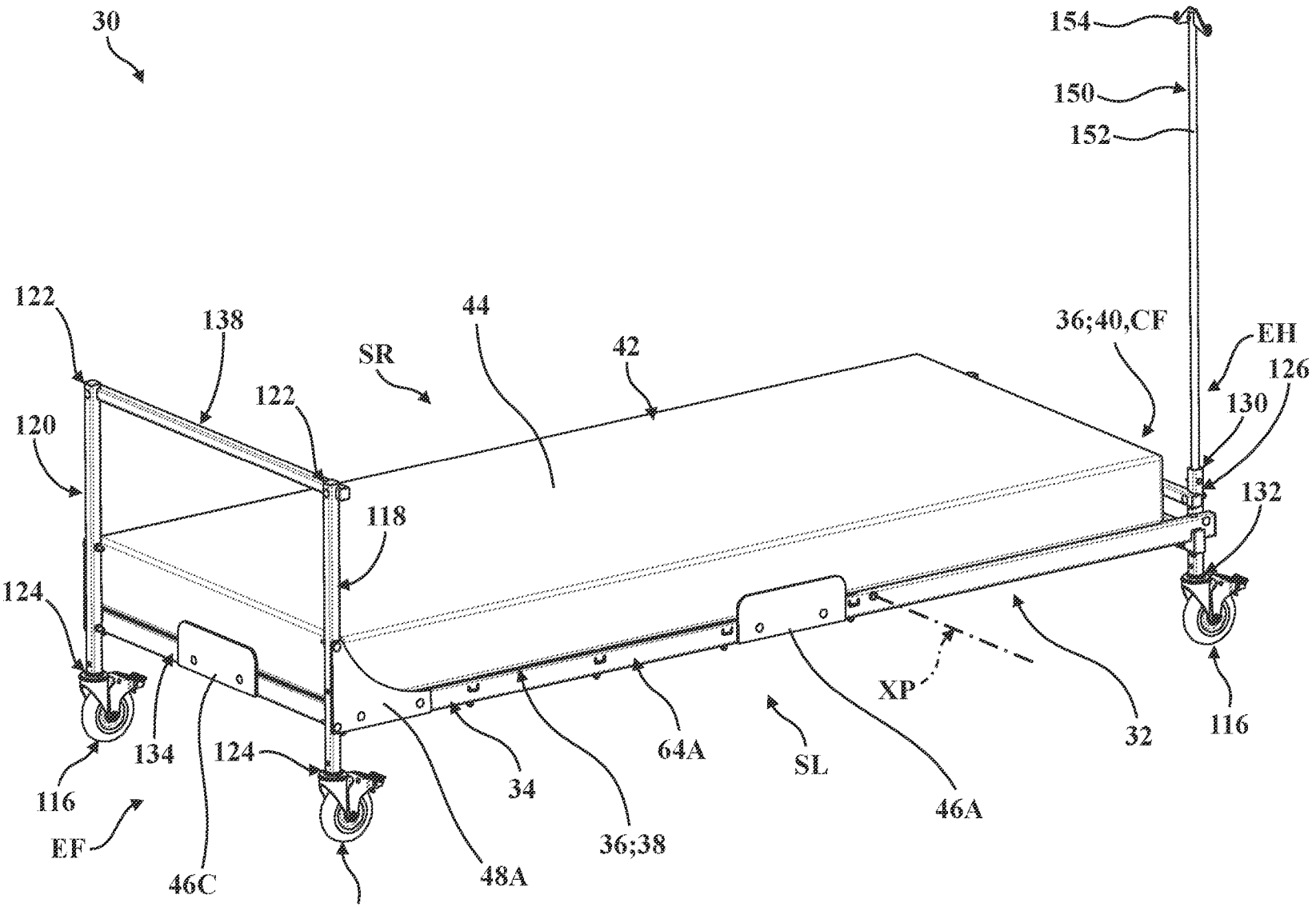
FIG. 1C is another perspective view of the patient support apparatus of FIGS. 1A-1B, shown with the fowler deck section arranged in a flat configuration.
Figure 2:
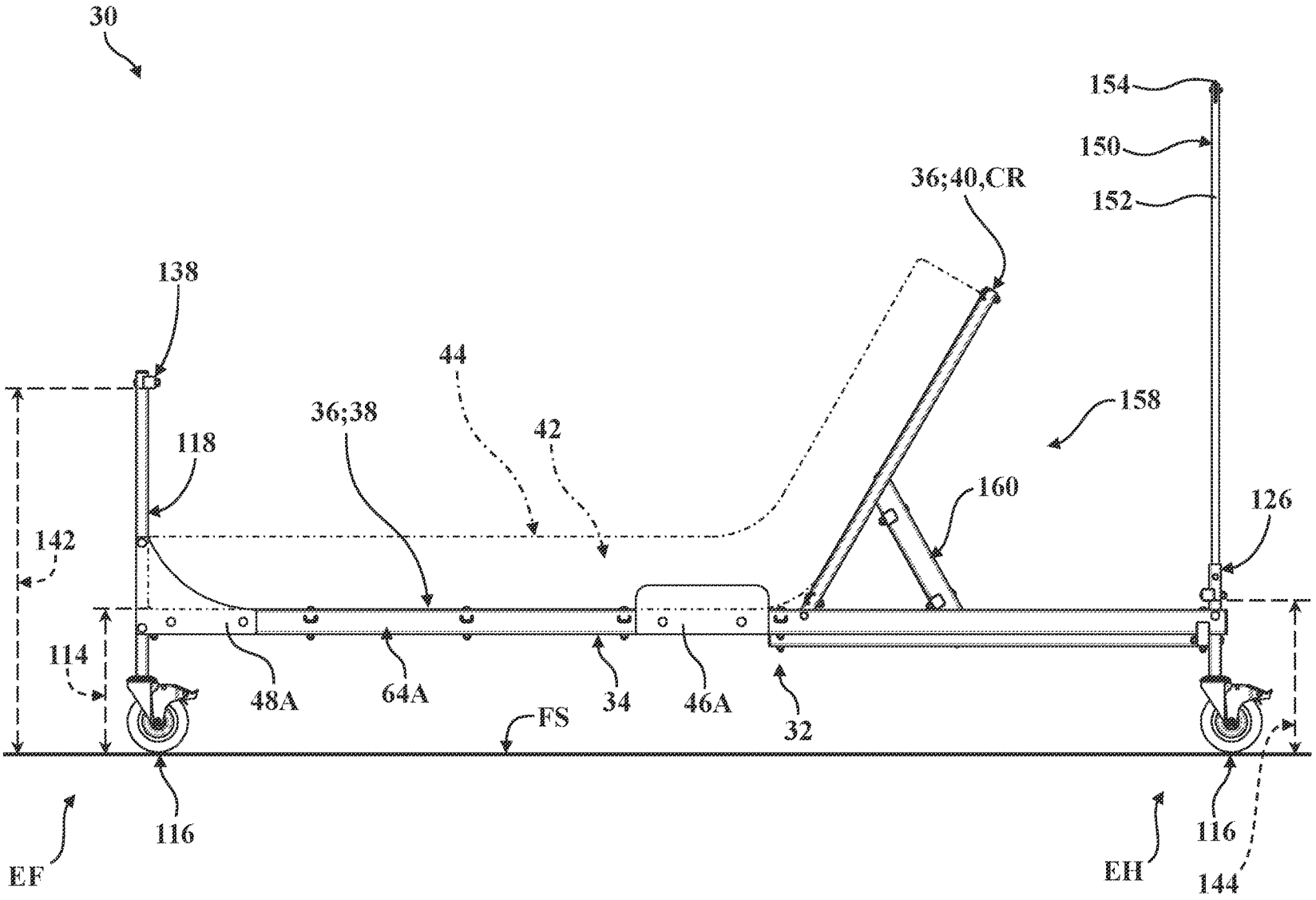
FIG. 2 is a left-side plan view of the patient support apparatus of FIGS. 1A-1C with the mattress depicted in phantom, and shown with the fowler deck section arranged in the raised configuration

As shown in FIGS. 1A-2, a mattress 42 may be supported on the patient support deck 36 for concurrent movement with the fowler deck section 40 between the patient support configurations described above. The mattress 42 generally defines a patient support surface 44 for supporting the patient above the patient support deck 36. It will be appreciated that the mattress 42 may be of a number of different styles and configurations without departing from the scope of the present disclosure. In some embodiments, the patient support apparatus 30 may employ one or more keeper plates 46A, 46B, 46C and/or gusset plates 48A, 48B to help restrict movement of the mattress 42 relative to the base frame 34 or other parts of the patient support apparatus 30. In the representative embodiment illustrated herein, a first keeper plate 46A is arranged between the head end EH and the foot end EF on the first lateral side SL, a second keeper plate 46B is arranged between the head end EH and the foot end EF on the second lateral side SL, an end keeper plate 46C is arranged adjacent to the foot end EF generally between the first and second lateral sides SL, SR, a first gusset plate 48A is arranged adjacent to the foot end EF along the first lateral side SL, and a second gusset plate 48B is arranged adjacent to the foot end EF along the second lateral side SR. Here, each of the plates 46A, 46B, 46C, 48A, 48B are at least partially coupled to a portion of the base frame 34. However, it will be appreciated that plates could be coupled to other parts of the patient support apparatus 30 (e.g., to the fowler deck section 40). Other configurations are contemplated.

Referring, generally, to FIGS. 1A-24, in the representative embodiments illustrated herein, various components of the patient support apparatus 30 are depicted in various stages of assembly (or disassembly) as being coupled, attached, or otherwise assembled together utilizing various types of fasteners, including threaded bolts 50 and nuts 52, washers 54, clevis pins 56, bushings 58, rue clips 60, and/or cotter pins 62. While the specific arrangement and assembly of various portions of the patient support apparatus 30 will be described in greater detail below, those having ordinary skill in the art will appreciate that the fasteners 50, 52, 54, 56, 58, 60, 62 illustrated throughout the drawings may be of other styles, types, and/or configurations, without departing from the scope of the present disclosure. Moreover, it will be appreciated that the fasteners 50, 52, 54, 56, 58, 60, 62 illustrated throughout the drawings are employed to facilitate assembly of the patient support apparatus 30 quickly and with basic hand tools. For the purposes of clarity and consistency, the fasteners 50, 52, 54, 56, 58, 60, 62 are not each individually labeled throughout the drawings with separate reference numerals, and may be shown in various arrangements between different drawings for context (e.g., between progressive exploded views). Furthermore, the term "fastener" may be used interchangeably with other terms utilized herein, including without limitation the terms bolt 50, nut 52, washer 54, clevis pin 56, bushing 58, rue clip 60, and/or cotter pin 62.

While various types of fasteners 50, 52, 54, 56, 58, 60, 62 are contemplated for securing components of the patient support apparatus 30 together, as will be appreciated from the subsequent description below, aspects of the present disclosure are directed towards structural components with formations that interlock or otherwise can be attached together in a way that promotes reliable stability and rigidity of the support structure 32 while, at the same time, allowing the patient support apparatus 30 to be assembled without complex machinery or tools (e.g., welding equipment). To this end, various structural components of the support structure 32 are realized with rigid tubing (e.g., rectangular steel tubing) that has been cut to length and has had various reliefs, apertures, slots, and the like formed therein. While the specific types and arrangements of these structural components, relief, apertures, slots, and the like are described in greater detail below, it will be appreciated that their formation can be effected via conventional manufacturing techniques and equipment. By way of non-limiting example, laser cutting, waterjet cutting, plasma cutting, wire electrical discharge machining, drilling, combinations thereof, and the like may be utilized to form one or more components of the support structure 32 described in greater detail below. In some embodiments, for example, the formation made in each of the components of the support structure 32 can be made using a single type of machining process (e.g., laser cutting). However, it will be appreciated that other configurations are contemplated.

As noted above, the base frame 34 is arranged for movement about the floor surface FS, and generally defines the head end EH and the foot end EF of the patient support apparatus 30. In the embodiments illustrated throughout the drawings, the base frame 34 includes a first longitudinal rail 64A arranged on the first lateral side SL, and a second longitudinal rail 64B arranged on the second lateral side SR. The first and second longitudinal rails 64A, 64B each extend between a respective distal rail end 66 arranged adjacent to the foot end EF, and a proximal rail end 68 arranged adjacent to the head end EH (see FIGS. 11-15). The first and second longitudinal rails 64A, 64B also each respectively comprise an outer rail surface 70, an inner rail surface 72, an upper rail surface 74, and a lower rail surface 76 (see FIGS. 14-17 and 19-21). The inner rail surfaces 72 of the first and second longitudinal rails 64A, 64B face towards each other (see FIG. 14).

As is best illustrated by FIGS. 14-19, the first and second longitudinal rails 64A, 64B are each respectively provided with a plurality of lateral receivers, generally indicated at 78, formed therein as described in greater detail below, to facilitate assembly of the base deck section 38 to the base frame, as well as to provide significant rigidity and stability to the support structure 32. To this end, the base deck section 38 is operatively attached to the first and second longitudinal rails 64A, 64B and includes a plurality of lateral braces 80 each having notched ends, generally indicated at 82 (see FIG. 16). The base deck section 38 of the patient support deck 36 also includes a base deck skin 84 supported on the first and second longitudinal rails 64A, 64B and on the plurality of lateral braces 80. The notched ends 82 of the lateral braces 80 are each shaped to be inserted into a respective one of the lateral receivers 78 formed in the first and second longitudinal rails 64A, 64B (see FIG. 17) to assemble the patient support apparatus 30. Each of the portions of the first and second longitudinal rails 64A, 64B and the lateral braces 80 introduced above will be described in greater detail below.

Figure 16:
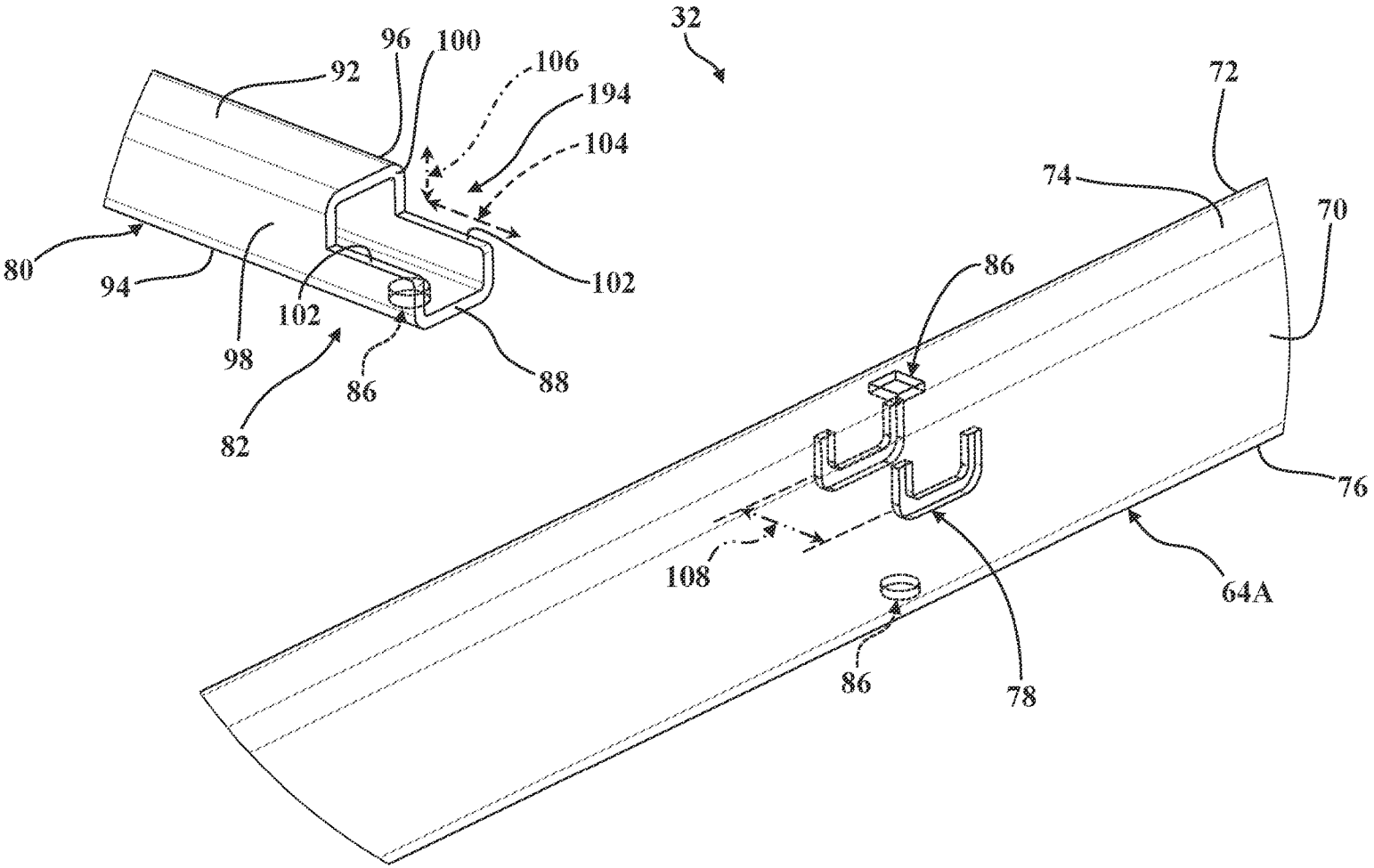
FIG. 16 is an enlarged, partial perspective view of portions of the base deck section of FIG. 15 taken at indicia 16 in FIG. 15, with portions of the longitudinal rail and the lateral brace depicted in phantom, and shown with a notched end of the lateral brace spaced from and adjacent to a lateral receiver formed in the longitudinal rail.

As shown in FIG. 16, in the representative embodiment illustrated herein, the first and second longitudinal rails 64A, 64B are each provided with four lateral receivers 78 that are arranged in spaced relation from each other in the longitudinal direction to couple to a respective one of the notched ends 82 of four lateral braces 80. However, it will be appreciated that other quantities of lateral braces 80, arranged in various ways, may be utilized. The lateral receivers 78 of each of the respective first and second longitudinal rails 64A, 64B are each formed or otherwise defined extending through the outer rail surface 70 and through the inner rail surface 72, and are spaced vertically between the upper rail surface 74 and the lower rail surface 76. However, and as will be appreciated from the subsequent description of other structural components below, other arrangements are contemplated and the lateral receivers 78 could be arranged so as to extend through the upper rail surface 74 or the lower rail surface 76 in some embodiments.

As is best illustrated with reference to FIGS. 15-19, the first and second longitudinal rails 64A, 64B each include a plurality of fastener apertures 86 defined or otherwise formed in the upper rail surface 74 and in the lower rail surface 76. Here, as best shown in FIG. 16, the fastener apertures 86 formed in the upper rail surfaces 74 may be of different styles, shapes, or configurations from the fastener apertures 86 formed in the lower rail surfaces 76. By way of illustrative example, the fastener apertures 86 could be configured with square-shaped profiles, with circular-shaped profiles, or other profiles, and may be generally configured to facilitate receiving or otherwise cooperating with different types of fasteners, such as bolts 50. More specifically, in some embodiments, square-shaped profile fastener apertures 86 may be utilized to "key" to a correspondingly-shaped square-shaped portion of a carriage bolt 50 (not shown in detail), and various profiles can be utilized to facilitate receiving threaded or unthreaded shaft portions of bolts 50 therethrough. Other configurations are contemplated.

In addition to fastener apertures 86 formed in the upper rail surfaces 74 and in the lower rail surfaces 76 of the first and second longitudinal rails 64A, 64B, fastener apertures 86 are also formed in the base deck skin 84 as well as in the lateral braces 80 adjacent to each of the notched ends 82. Here, a plurality of fasteners, such as bolts 50, are employed to facilitate attaching the base deck section 38 to the first and second longitudinal rails 64A, 64B, with each bolt 50 passing through one of the fastener apertures 86 defined in the base deck skin 84, through one of the fastener apertures 86 defined in the upper rail surface 74, through one of the fastener apertures defined adjacent to the notched ends 82, and out of one of the fastener apertures 86 defined in the lower rail surface 76 (see FIGS. 18-19). Nuts 52, with or without washers 54, can be threaded onto the bolts 50 with simple hand tools.

Figure 15:
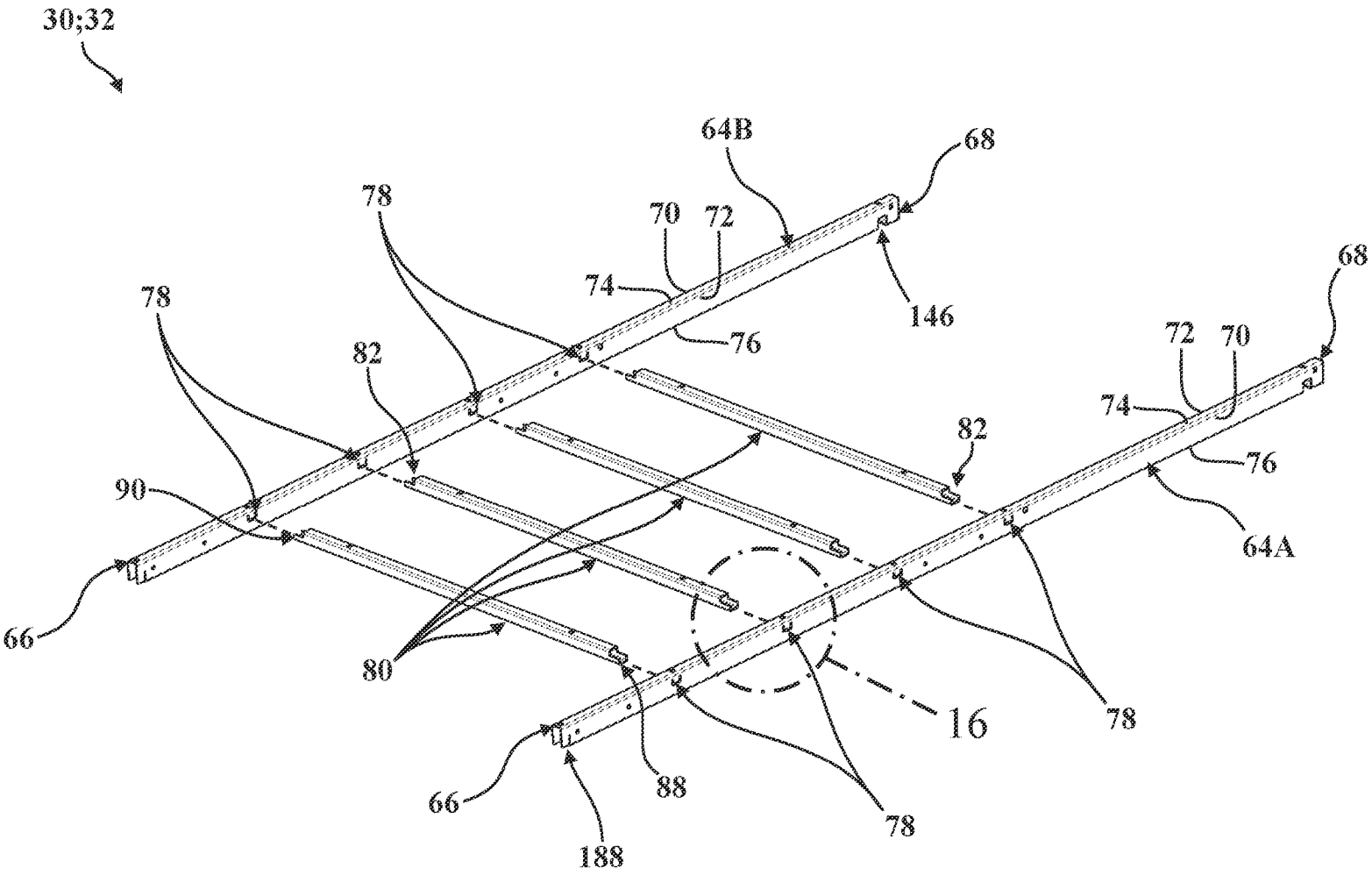
FIG. 15 is a partially-exploded perspective view of portions of the patient support apparatus of FIG. 14, shown with longitudinal rails spaced from lateral braces of the base deck section.
Figure 17:
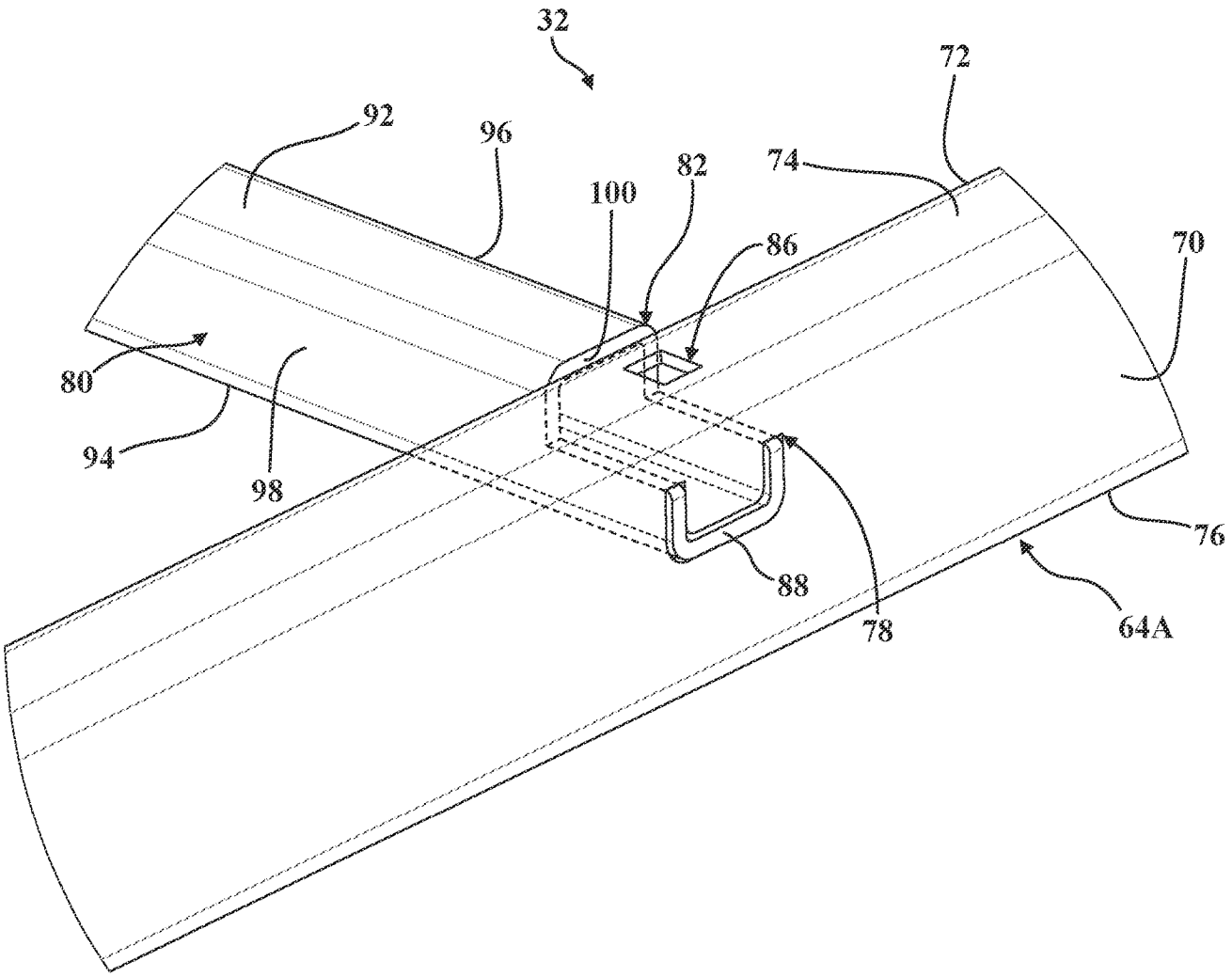
FIG. 17 is another enlarged, partial perspective view of the longitudinal rail and the lateral brace of FIG. 16, shown with the notched end of the lateral brace disposed in the lateral receiver of the longitudinal rail.
Figure 18:
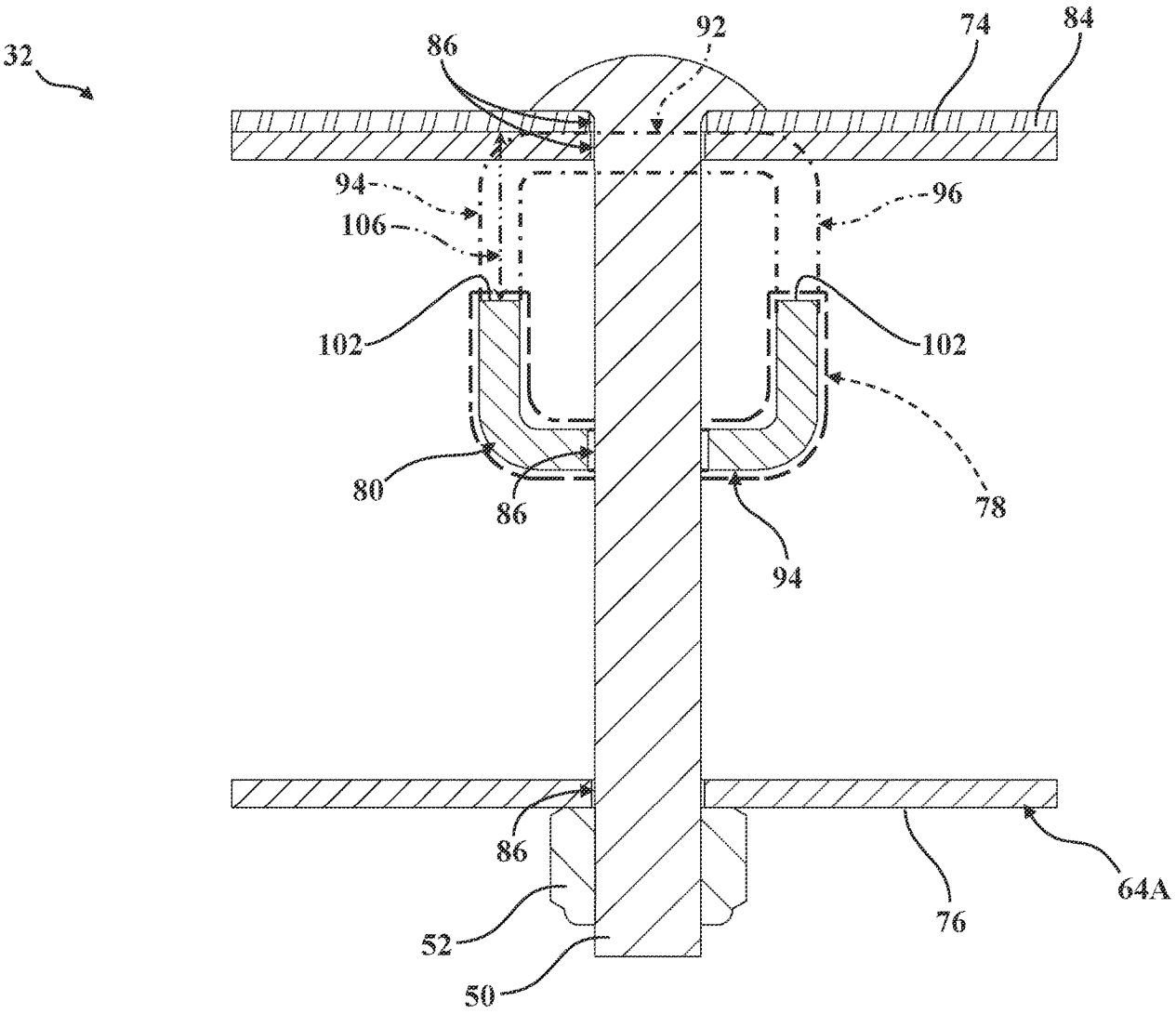
FIG. 18 is a partial, slice sectional view taken along line 18-18 in FIG. 3.
Figure 19:
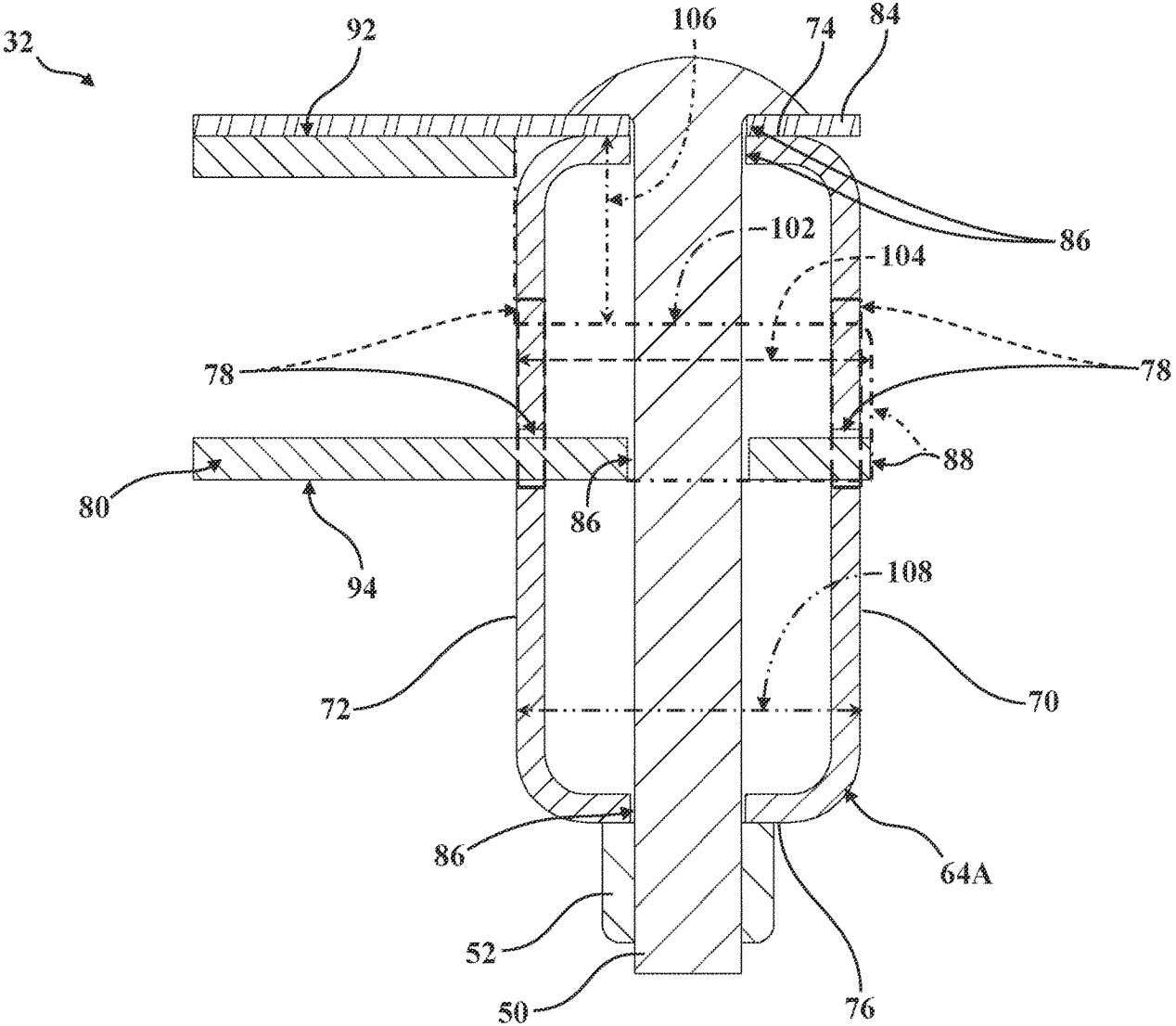
FIG. 19 is a partial, slice sectional view taken along line 19-19 in FIG. 3.
Figure 20:
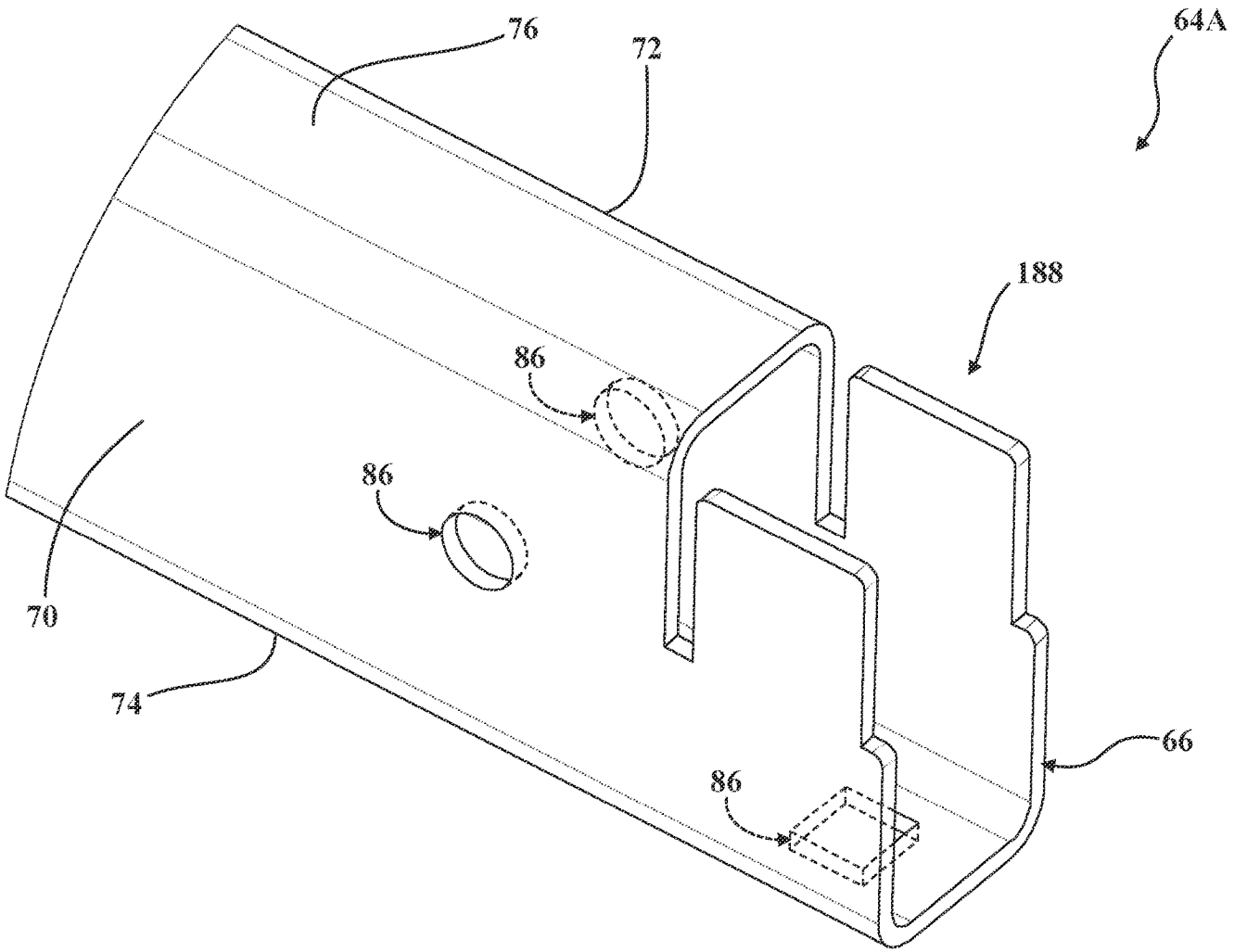
FIG. 20 is an enlarged, partial perspective view of a distal rail end of one of the longitudinal rails of FIG. 15, shown with portions of the longitudinal rail depicted in phantom.
Figure 21:
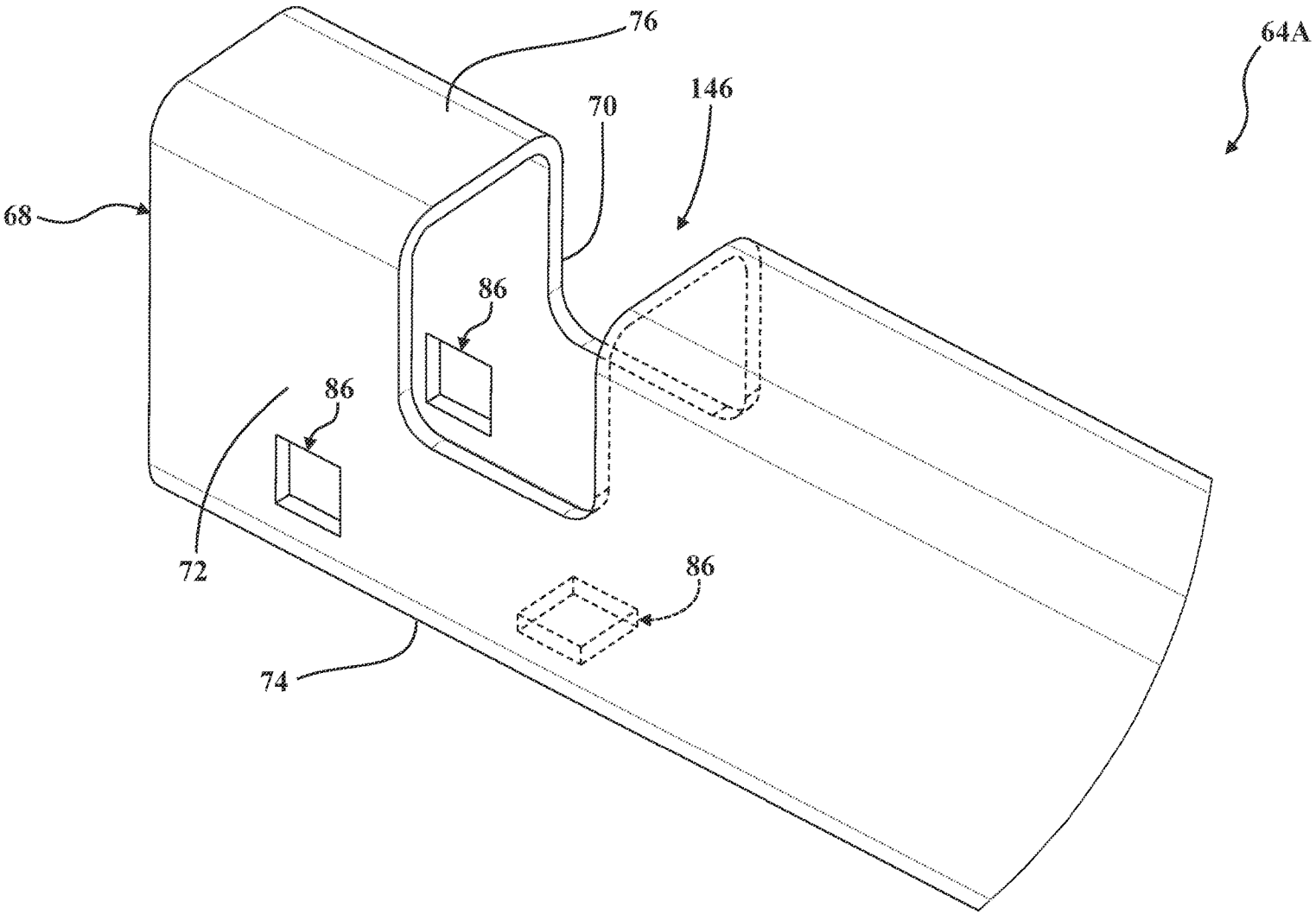
FIG. 21 is an enlarged, partial perspective view of a proximal rail end of one of the longitudinal rails of FIG. 15, shown with portions of the longitudinal rail depicted in phantom.
Figure 22:
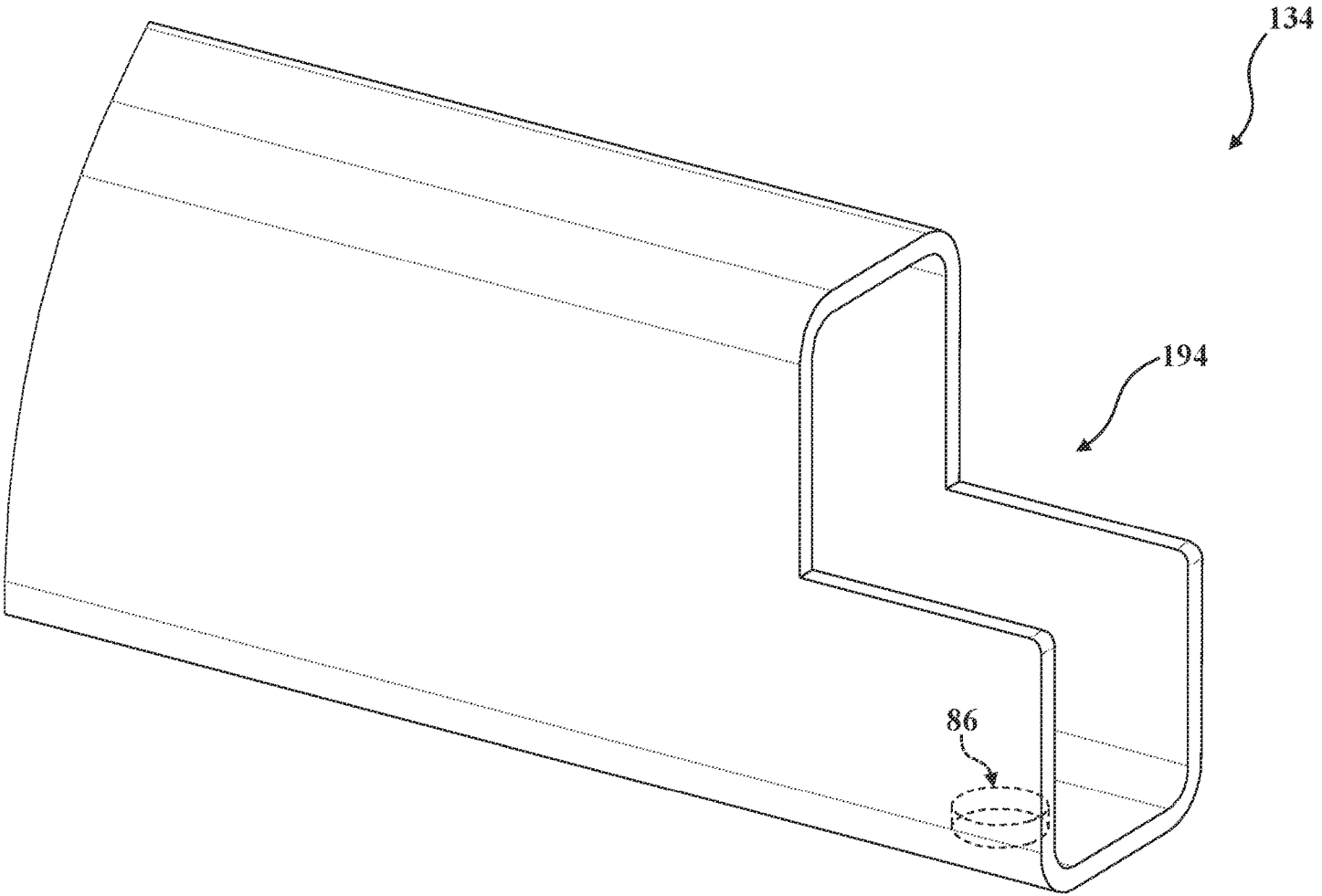
FIG. 22 is an enlarged, partial perspective view of an end of the foot-end rail of FIG. 14, shown with portions of the foot-end rail depicted in phantom.
Figure 23:
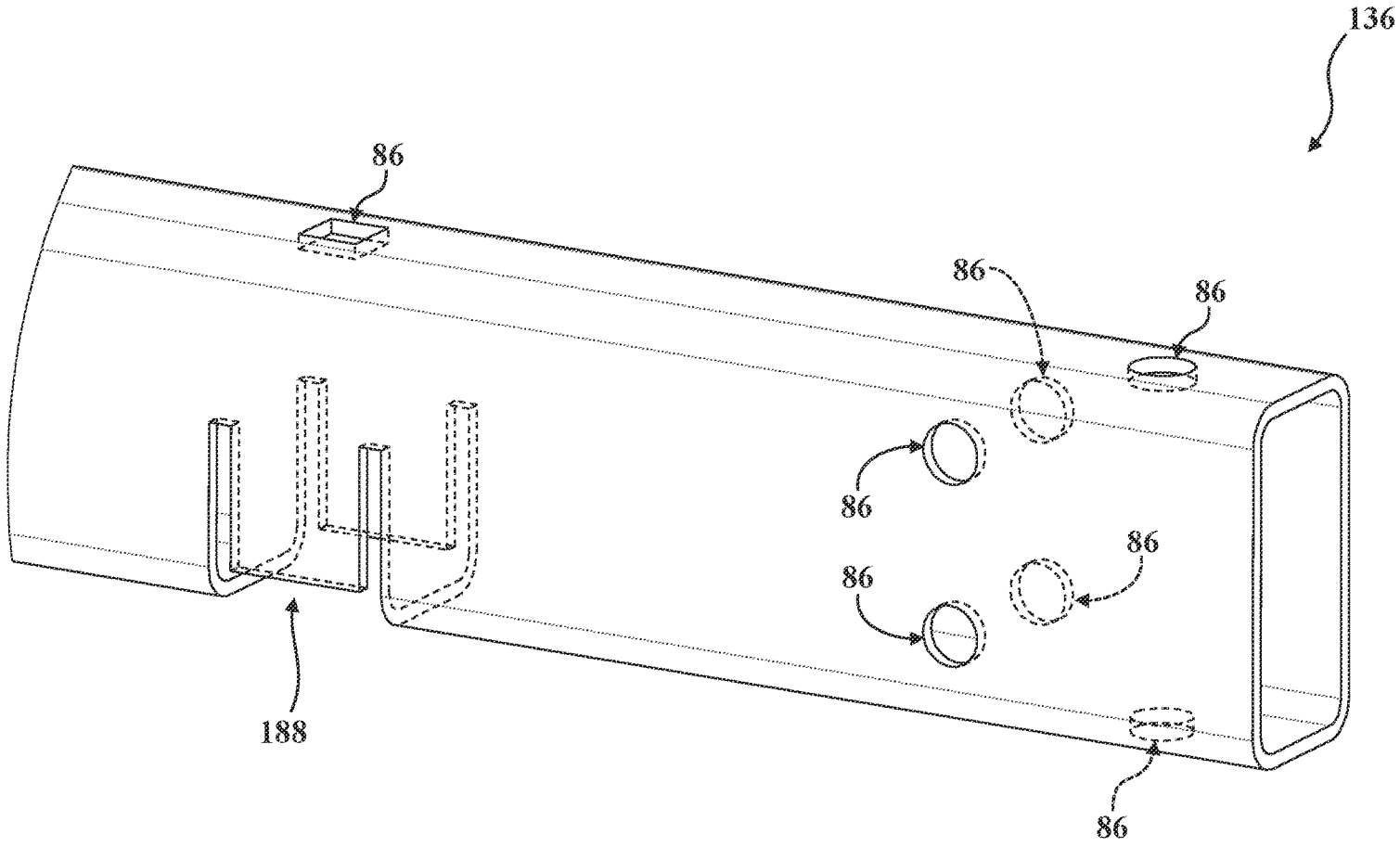
FIG. 23 is an enlarged, partial perspective view of an end of the head-end rail of FIG. 14, shown with portions of the head-end rail depicted in phantom.

With continued reference to FIGS. 15-19, in the illustrated embodiment, each of the respective lateral braces 80 extends laterally between opposing first and second lateral brace end faces 88, 90 (see FIG. 15; see also FIGS. 16-17). The lateral braces 80 also have respective upper and lower brace surfaces 92, 94, as well as respective proximal and distal brace surfaces 96, 98 (see FIG. 16). In the representative embodiment illustrated herein, the lateral braces 80 have a generally rectangular profile defined by the upper brace surface 92, the lower brace surface 94, the proximal brace surface 96, and the distal brace surface 98. More specifically, the lateral braces 80 have a square-shaped profile in the illustrated embodiments. However, it will be appreciated that other configurations are contemplated.

As is best shown in FIG. 16, the lateral braces 80 also have lateral notch faces 100 and vertical notch faces 102 defined or otherwise formed at each notched end 82. Here, the lateral notch faces 100 are spaced laterally from, but arranged substantially parallel to, the first and second lateral brace end faces 88, 90. Similarly, the vertical notch faces 102 are spaced vertically from, but arranged substantially parallel to, the upper and lower brace surfaces 92, 94. Here too, the vertical notch faces 102 are arranged generally perpendicular to the lateral notch faces 100. The vertical notch face 102 is arranged between the upper brace surface 92 and the lower brace surface 94, substantially equidistantly, but it will be appreciated that other arrangements are contemplated. A notch length 104 is defined by the notched ends 82 extending between the first and second lateral brace end faces 88, 90 and the lateral notch faces 100 arranged adjacent thereto, and a notch height 106 is defined by the notched ends 82 extending between the upper brace surfaces 92 and the vertical notch faces 102. Here, the notch length 104 is larger than the notch height 106. A rail width 108 is defined between the outer and inner rail surfaces 70, 72 of each of the respective first and second longitudinal rails 64A, 64B (see FIGS. 16 and 19). The notch length 104 is slightly larger than or equal to the rail width 108, but other configurations are contemplated. In the representative embodiments illustrated herein, the lateral receivers 78 each have a generally "closed" U-shaped profile that corresponds to the shape and profile of the notched ends 82 of the lateral braces 80. In some embodiments, the lateral receivers 78 may be sized slightly larger than or equal to the notched ends 82 (see FIG. 18). However, as will be appreciated from the subsequent description of other portions of the support structure 32, other profiles, shapes, and configurations are contemplated, and notched engagement between the lateral braces 80 and the first and second longitudinal rails 64A, 64B may be achieved using notch configurations other than the "corner notch" configuration of the notched ends 82 and/or the "closed notch" configuration of the lateral receivers 78 illustrated in FIG. 16.

As noted above, the base deck section 38 employs the base deck skin 84 which, among other things, defines a portion of the patient support deck 36 upon which the mattress 42 can be supported. As best shown in FIG. 3, the base deck skin 84 defines a base deck width 110 and a base deck length 112 that is larger than the base deck width 110. Here, the base deck skin 84 has a base deck aspect ratio RBD of the base deck length 112 to the base deck width 110 that is larger than 1.1:1. In some embodiments, the base deck aspect ratio RBD is larger than 1.4:1. As shown in FIG. 2, the base deck skin 84 is spaced from the floor surface FS at a fixed base deck height 114, which is smaller than half the base deck length 112. Here, a base deck height ratio RBH of the base deck length 112 to the fixed base deck height 114 is larger than 2.0:1. In some embodiments, the base deck height ratio RBH is larger than 4.0:1. It will be appreciated that, in the representative embodiments described herein, the base deck section 38 is not movable relative to the base frame 34 or other parts of the patient support apparatus 30. Put differently, the base deck section 38 is arranged at a "fixed" height relative to the floor surface FS and cannot be raised or lowered. Here, the base deck skin 84 and the base deck section 38 are configured to cooperate with the mattress 42 to provide support for a patient at a relatively low height to the floor surface FS, which helps to prevent injury that might otherwise occur at higher heights, and helps promote easy ingress and egress from the patient support apparatus.

Referring now to FIGS. 1-5, as noted above, the base frame 34 is arranged for movement about the floor surface FS. To this end, in the representative embodiment illustrated herein, the patient support apparatus 30 employs caster wheels 116 operatively attached to the base frame 34 to promote movement. Here, caster wheels 116 are arranged at the four corners of the base frame 34. More specifically, in the illustrated embodiment, the base frame 34 also includes laterally-spaced first and second uprights 118, 120 arranged adjacent to the foot end EF which extend between respective upper and lower upright ends 122, 124, and laterally-spaced first and second struts 126, 128 arranged adjacent to the head end EH which extend between respective upper and lower strut ends 130, 132, with caster wheels 116 operatively attached to the lower upright ends 124 of the first and second uprights 120, 122 and to the lower strut ends 130 of the first and second struts 126, 128. It will be appreciated that the caster wheels 116 could be of various types, styles, or configurations, and one or more of the caster wheels 116 could employ integrated braking functionality, integrated steer-lock functionality, and the like. While each of the four caster wheels 116 are illustrated as having integrated braking functionality (not shown in detail), it will be appreciated that less than all four caster wheels 116 could have integrated braking functionality in some embodiments. By way of non-limiting example, two of the four caster wheels 116 could have integrated braking functionality (e.g., attached to the first upright 118 and the second strut 128), and the other two could omit integrated braking functionality (e.g., attached to the second upright 120 and the first strut 126). Other configurations are contemplated.

Figure 10:
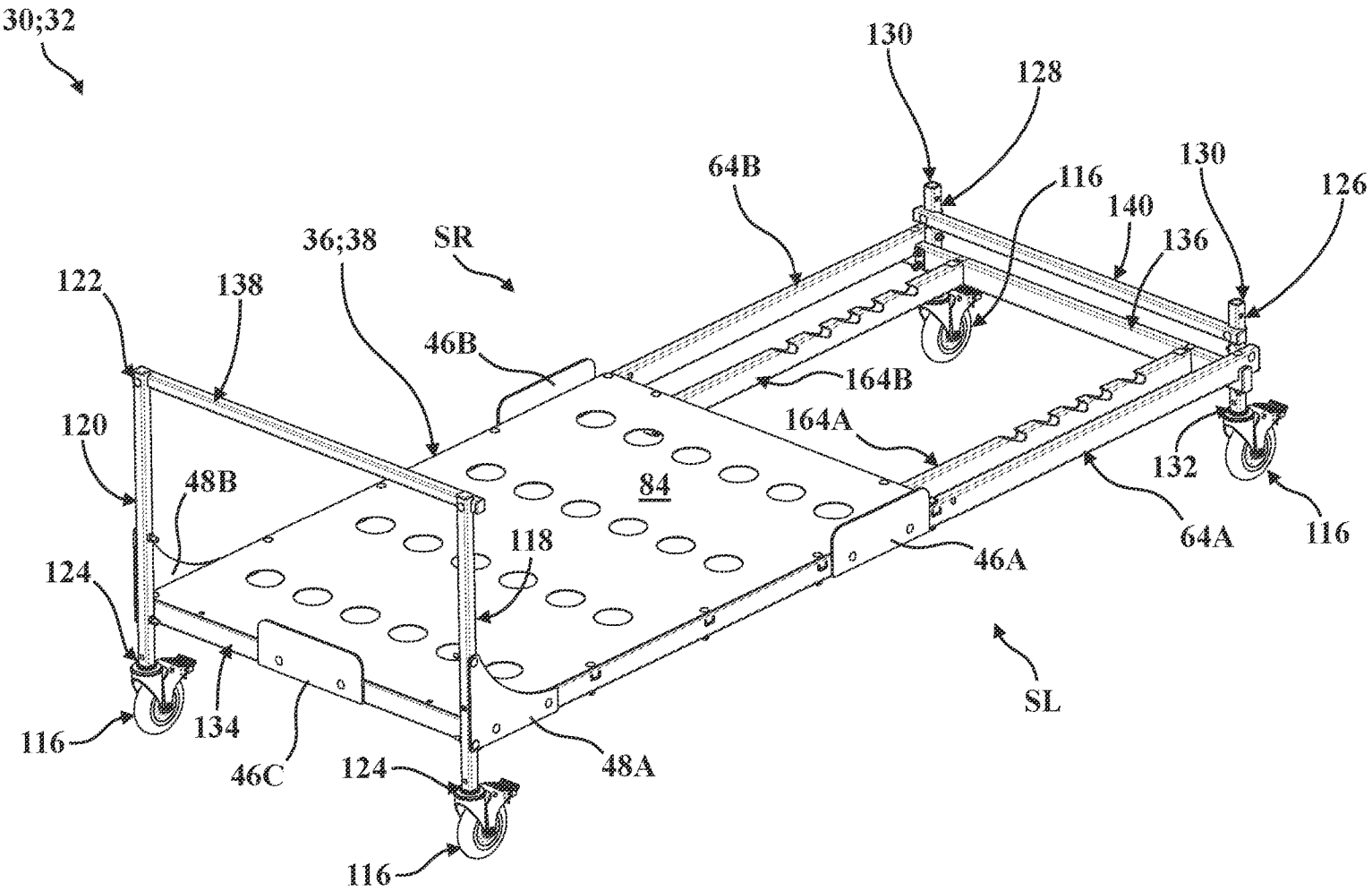
FIG. 10 is a perspective view of portions of the patient support apparatus of FIG. 5 depicted without the pole assembly or the fowler subassembly.
Figure 11:
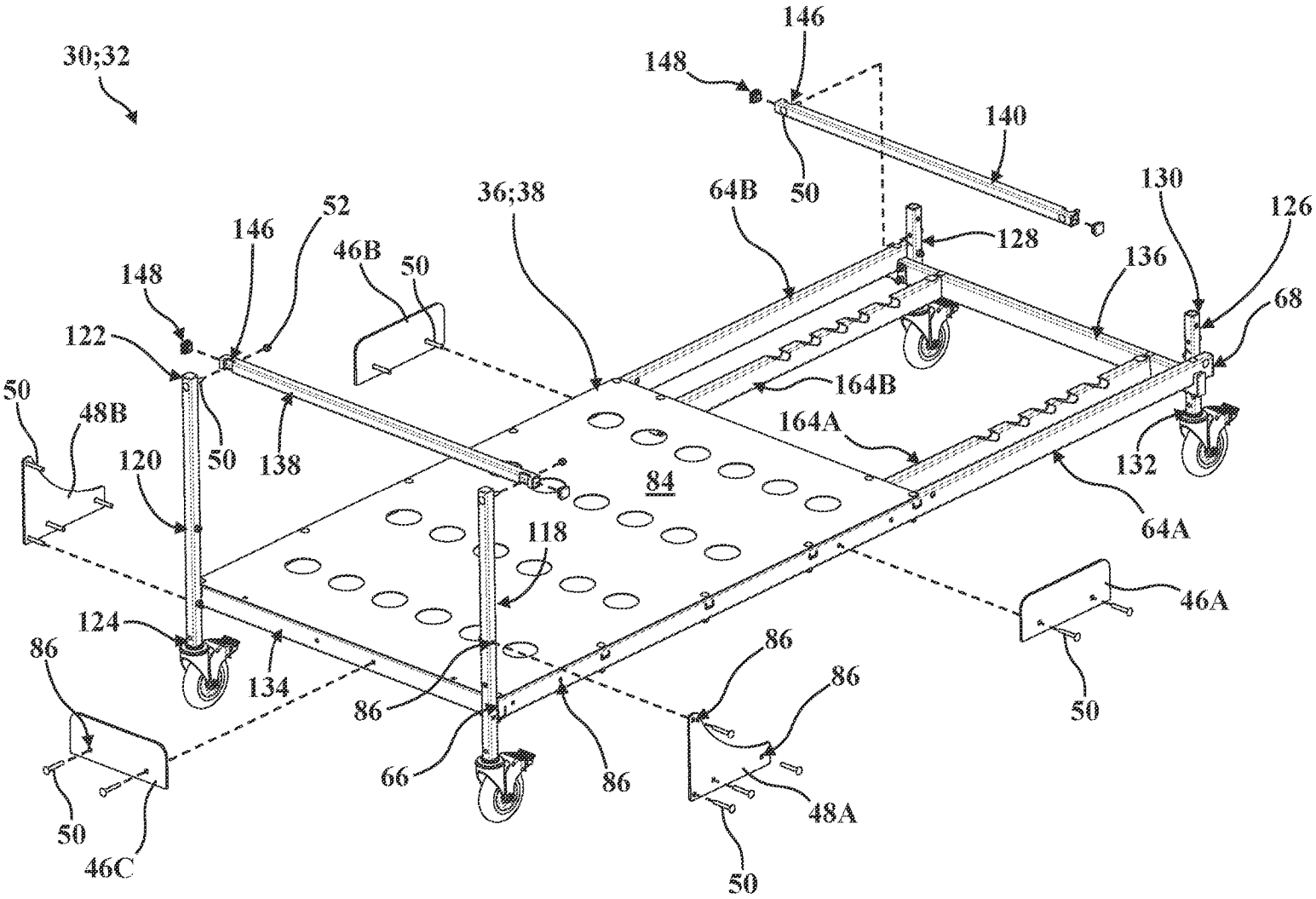
FIG. 11 is a partially-exploded perspective view of portions of the patient support apparatus of FIG. 10, shown with a push bar, a brace bar, gusset plates, keeper plates, fasteners, and caps spaced from other portions the patient support apparatus.
Figure 12:
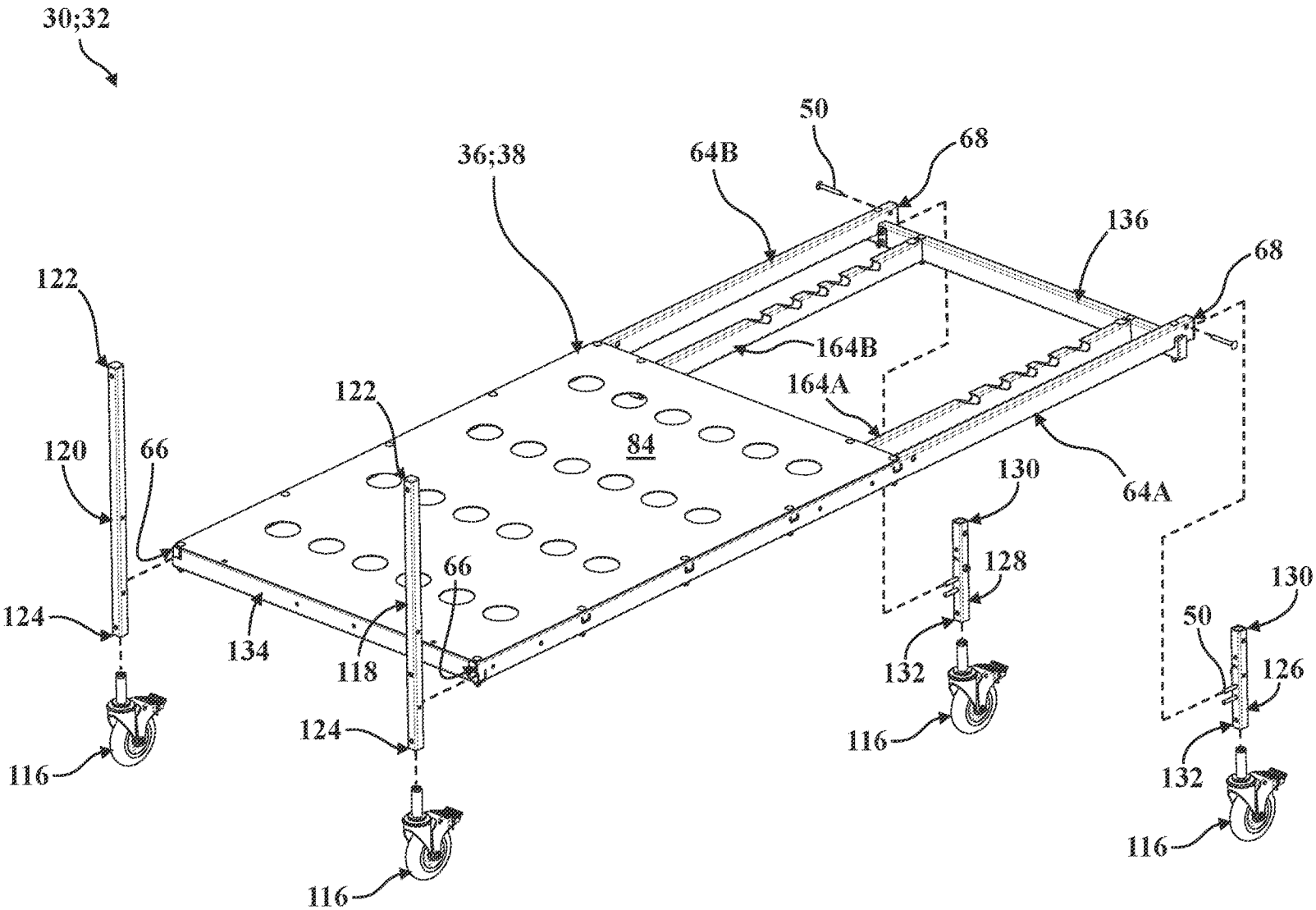
FIG. 12 is a partially-exploded perspective view of portions of the patient support apparatus of FIG. 11, shown with uprights, struts, caster wheels, and fasteners spaced from other portions of the patient support apparatus.

As is best illustrated in FIGS. 10-12, in some embodiments, the first and second uprights 118, 120 are respectively disposed in abutment with the distal rail ends 66 of the first and second longitudinal rails 64A, 64B. Here, the first gusset plate 48A is coupled between the first upright 118 and the first longitudinal rail 64A, and the second gusset plate 48B is coupled between the second upright 120 and the second longitudinal rail 64B. To this end, the gusset plates 48A, 48B, the longitudinal rails 64A, 64B, and the first and second uprights 118, 120 are each provided with fastener apertures 86 arranged to receive fasteners (e.g., carriage bolts 50) used to secure the gusset plates 48A, 48B to the longitudinal rails 64A, 64B and to the first and second uprights 118, 120. This arrangement provides stability and rigidity to the support structure and, like other fasteners described herein, can likewise be assembled using simple hand tools. The base frame 34 also includes a foot-end rail 134 and a head-end rail 136 which are each disposed in notched (and fastened) engagement with the first and second longitudinal rails 64A, 64B, as described in greater detail below in connection with FIGS. 13-14. Similar to the gusset plates 48A, 48B, the keeper plates 46A, 46B, 46C are also operatively attached to the base frame 34 by utilizing fastener apertures 86 and fasteners (e.g., carriage bolts 50). Here, the first keeper plate 46A is coupled to the first longitudinal rail 64A, the second keeper plate 46B is coupled to the second longitudinal rail 64B, and the end keeper plate 46C is coupled to the foot-end rail 134. While not shown in detail herein, the first and second struts 126, 128 are disposed in abutment with, and secured via fasteners (e.g., carriage bolts 50) to, both the head-end rail 136 and the respective first and second longitudinal rails 64A, 64B.

Figure 24:
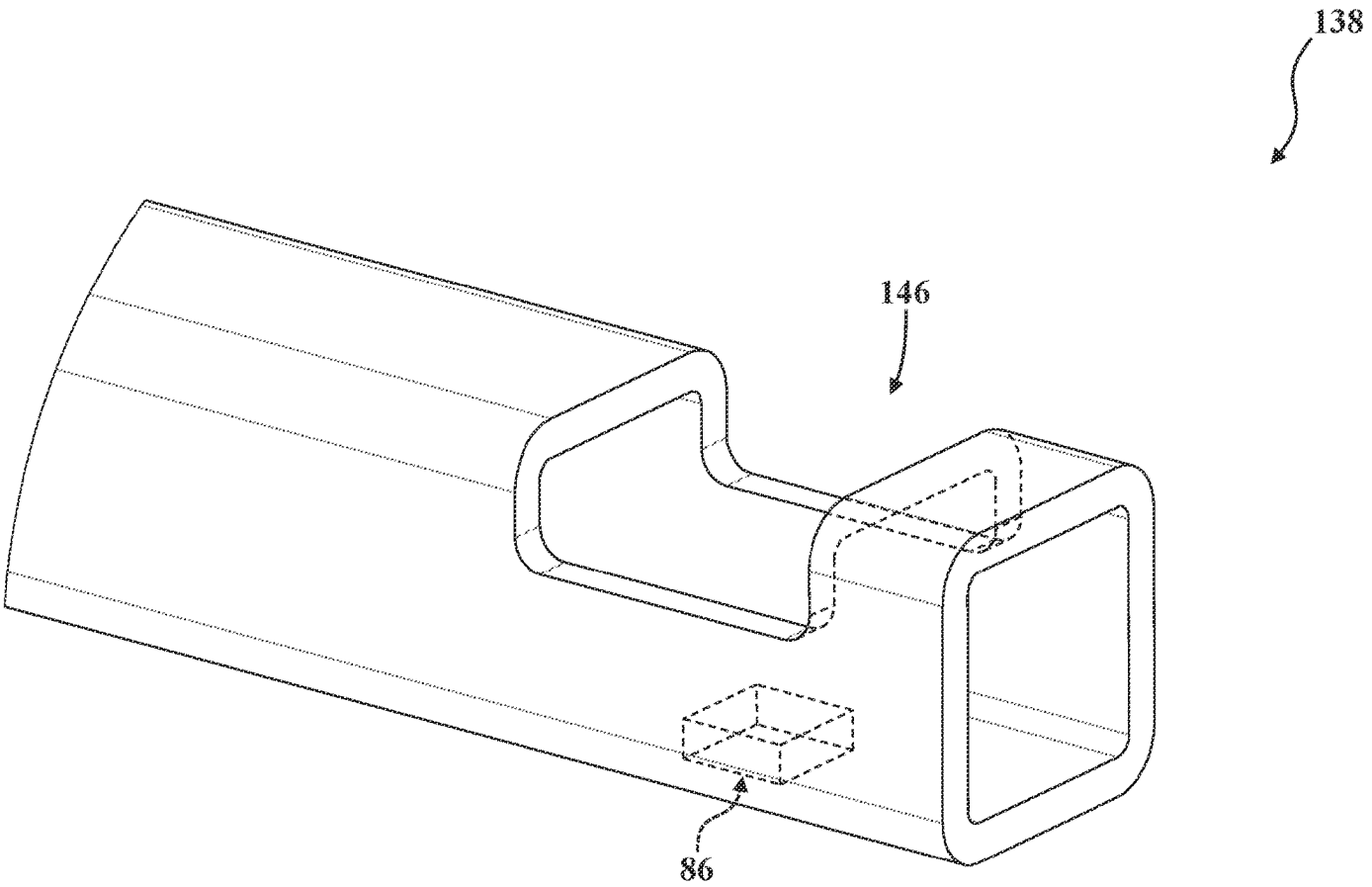
FIG. 24 is an enlarged, partial perspective view of an end of the push bar of FIG. 11, shown with portions of the upright depicted in phantom.

Referring now to FIGS. 10-11 and 24, in the representative embodiment illustrated herein, a push bar 138 is operatively attached to the first and second uprights 118, 120 adjacent to the upper upright ends 122, and a brace bar 140 is operatively attached to the first and second struts 126, 128 adjacent to the upper strut ends 130. Here, the push bar 138 and the brace bar 140 provide additional stability and rigidity to the support structure 32. In addition, the push bar 138 is arranged for engagement by a caregiver to facilitate movement of the patient support apparatus 30 about the floor surface FS, such as by pushing or pulling on the push bar 138. In the illustrated embodiment, the push bar 138 is arranged vertically higher than the brace bar 140. As shown in FIG. 2, in some embodiments, the push bar 138 is spaced from the floor surface FS at a fixed push bar height 142, and the brace bar 140 is spaced from the floor surface FS at a fixed brace bar height 144 that is smaller than the fixed push bar height 142. In some embodiments, a push bar ratio RPB of the fixed push bar height to the fixed base deck height is larger than 2.0:1. In some embodiments, the fixed brace bar height 144 is larger than the fixed base deck height 114. Other configuration are contemplated.

The push bar 138 and the brace bar 140 are disposed in notched and fastened engagement with the first and second uprights 118, 120 and the first and second struts 126, 128, respectively. To this end, open notches 146 are formed in the push bar 138 to receive and abut against surfaces of each of the first and second uprights 118, 120, via contact with surfaces defined by the open notches 146. Similarly, open notches 146 are also formed in the brace bar 140 to receive and abut against surfaces of each of the first and second struts 126, 128 via contact with surfaces defined by the open notches 146. In both cases, fastener apertures 86 formed in the first and second uprights 118, 120 and the push bar 138, as well as in the first and second struts 126, 128 and the brace bar 140, are arranged to receive fasteners (e.g., carriage bolts 50) to operatively attach the push bar 138 and the brace bar 140. In the representative embodiment illustrated herein, the push bar 138 and the brace bar 140, the first and second uprights 118, 120, and the first and second struts 126, 128 each have a generally rectangular (square-shaped) profile. However, it will be appreciated that other configurations are contemplated.

FIG. 24 depicts the arrangement the open notches 146 formed adjacent to lateral ends of the push bar 138, as well as the arrangement of a fastener aperture 86. It will be appreciated that similar arrangements are employed at lateral ends of the brace bar 140. For these type of open notches 146, such as is depicted in FIG. 24, a generally U-shaped profile is employed to facilitate contact about surfaces defined by the open notches 146 (e.g., three or more surfaces arranged for contact with portions of the first and second uprights 118, 120). Here, caps 148 may be inserted into lateral ends of the push bar 138 (as well as into lateral ends of the brace bar 140 and/or into the upper ends upright ends 122). It will be appreciated that the configuration of the open notches 146 used herein can be implemented as either single-sided (e.g., as illustrated with the open notches 146 formed in the push bar 138 and the brace bar 140 but not the first and second uprights 118, 120 or the first and second struts 126, 128), or double-sided (e.g., with open notches 146 formed in the push bar 138 and the brace bar 140 as well as in the first and second uprights 118, 120 and the first and second struts 126, 128; not shown here). Other configurations are contemplated.

Figure 5:
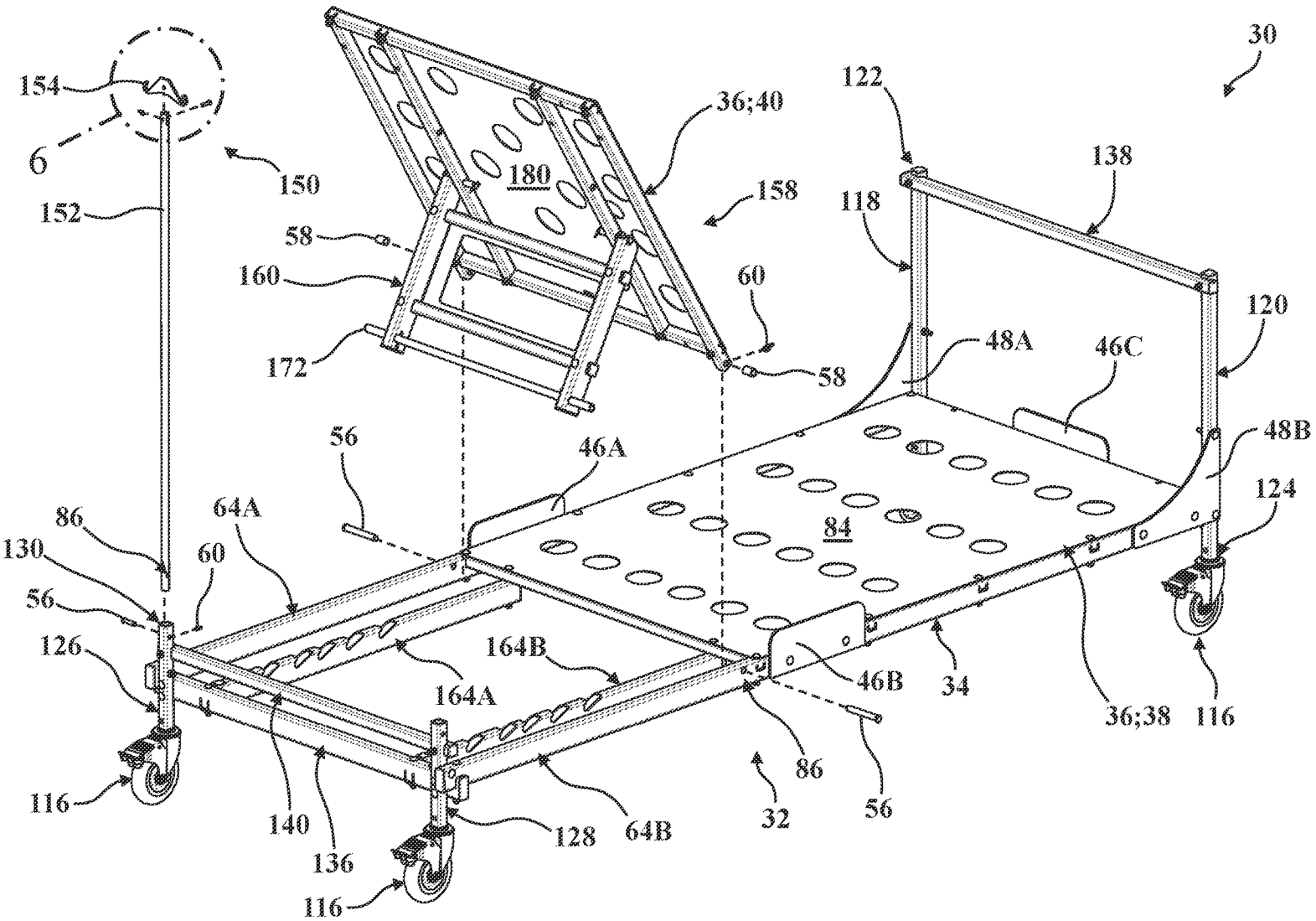
FIG. 5 is a partially-exploded perspective view of the patient support apparatus of FIG. 4, shown with portions of a pole assembly and a fowler subassembly spaced from the base frame.
Figure 6:
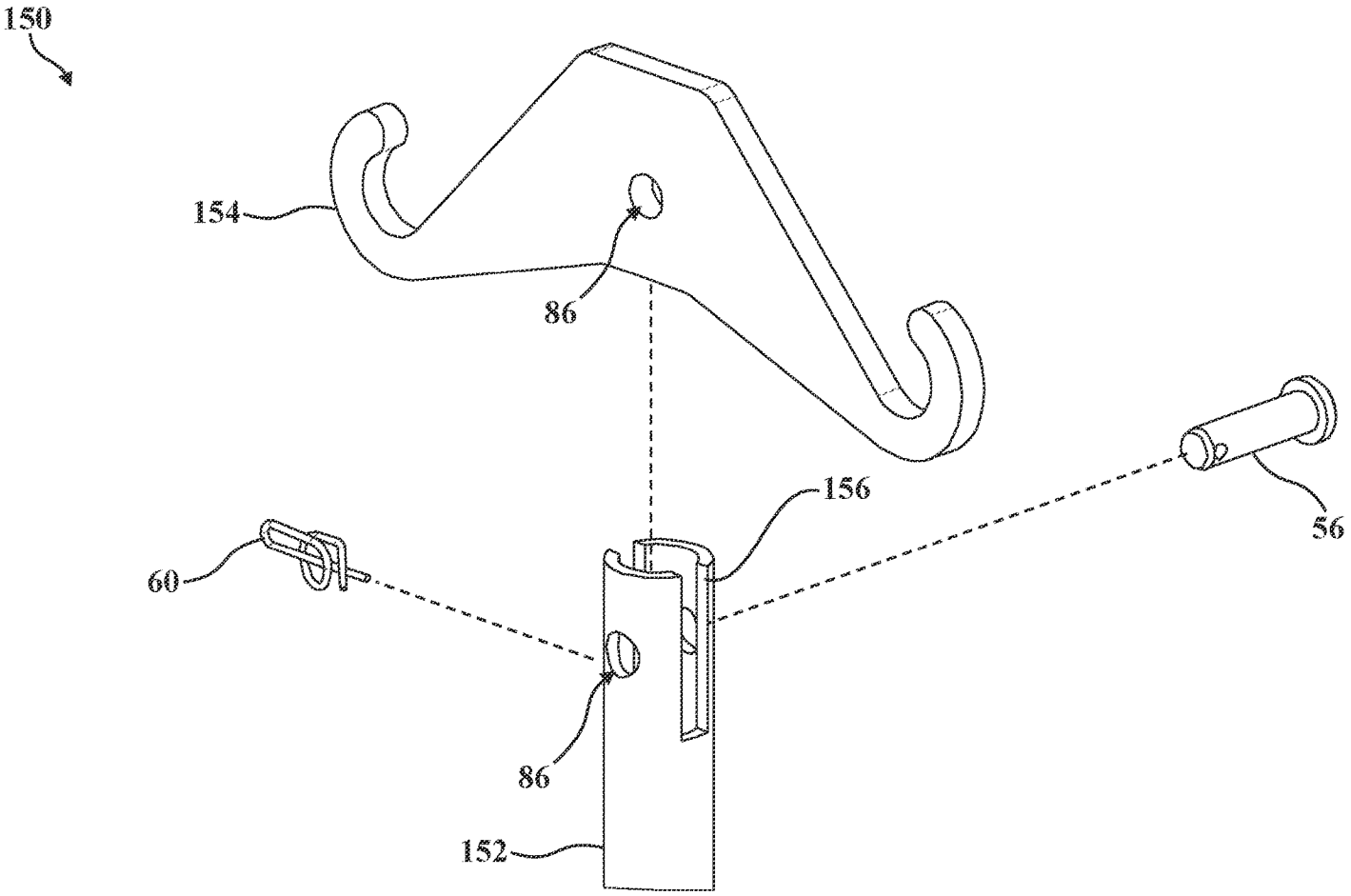
FIG. 6 is an enlarged, partial perspective view of portions of the pole assembly taken at indicia 6 in FIG. 5.
Figure 7:
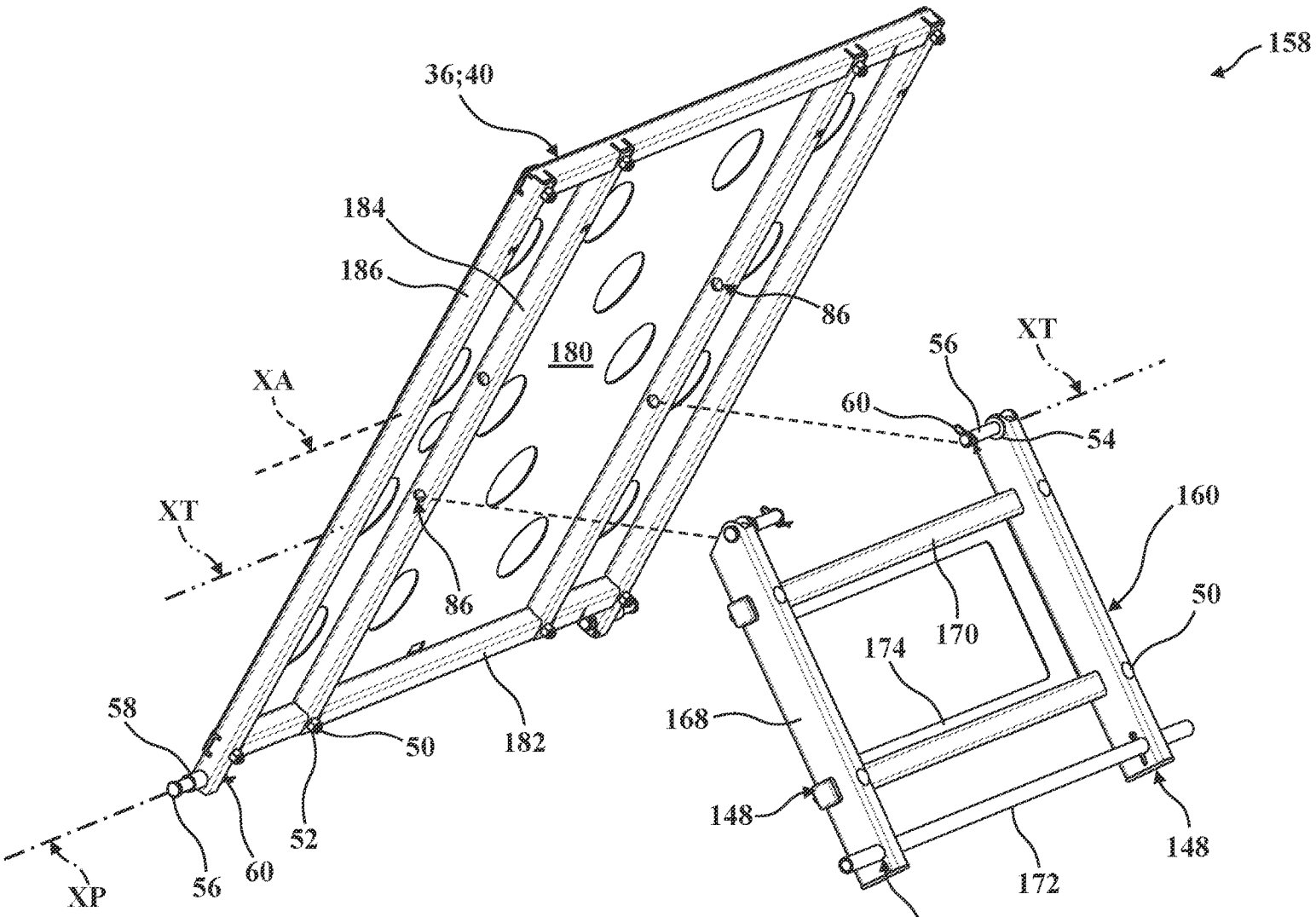
FIG. 7 is a partially-exploded perspective view of the fowler subassembly of FIG. 5, showing a fowler adjuster spaced from the fowler deck section.

Referring now to FIGS. 4-6, in some embodiments, the patient support apparatus 30 includes a pole assembly 150 that can be utilized to hang fluid bags (e.g., IV fluid) or other equipment from, and may also be employed to facilitate movement of the patient support apparatus 30 (e.g., via a caregiver pushing or pulling on the pole assembly 150). The pole assembly 150 generally includes a pole 152 (e.g., a cylindrical tube) that is sized and shaped to be inserted into one of the first and second struts 126, 128. While a single pole assembly 150 is shown being insertable into the first strut 126, it will be appreciated that pole assemblies 150 could be inserted into either or both struts 126, 128 (or neither strut 126, 128). Here too, fastener apertures 86 and fasteners (e.g., a clevis pin 56 and a rue clip 60) are employed to facilitate attachment of the pole assembly 150. To this end, fastener apertures 86 are formed in the pole 152 as well as in the first strut 126 to receive a clevis pin 56, to which a rue clip 60 can then be secured. As shown in FIG. 6, fastener apertures 86, a clevis pin 56, and a rue clip 60 are also employed to facilitate attaching a hanger 154 into a slot 156 formed in the pole 152.

Referring now to FIGS. 4-5 and 7-9, as noted above, the fowler deck section 40 is coupled to the base frame 34 for pivoting movement between various patient support configurations (see FIGS. 1A-1C) relative to the first and second longitudinal rails 64A, 64B. To this end, the fowler deck section 40 in the illustrated embodiment forms part of a fowler subassembly 158 which includes a fowler adjuster 160 that can be positioned between retaining notches 162 formed in first and second intermediate rails 164, 166 attached to the base frame 34. Each of the components of the fowler subassembly 158 introduced above will be described in greater detail below.

The fowler subassembly 158 is pivotably coupled to the base frame 34 about a pivot axis XP defined extending through the first and second longitudinal rails 64A, 64B via fastener apertures 86 formed therein. Here too, fastener apertures 86 are formed in the fowler deck section 40, and fasteners (e.g., clevis pins 56) are employed to facilitate pivoting movement of the fowler deck section 40 about the pivot axis XP. In the illustrated embodiment, clevis pins 56, bushings 58, washers 54, and rue clips 60 facilitate attachment of the fowler deck section 40 to the base frame 34. The fowler deck section 40 also includes other fastener apertures 86 formed therein to define a tilt axis XT spaced from the pivot axis XP. Here, the fowler adjuster 160 is pivotably coupled to the fowler deck section 40 via a similar arrangement of clevis pins 56, rue clips 60, and washers 54. As described in greater detail below, the fowler adjuster 160 can be pivotably coupled to one set of fastener apertures 86 which define the tilt axis XT, or to a different set of fastener apertures 86 which define an auxiliary tilt axis XA.

Figure 8:
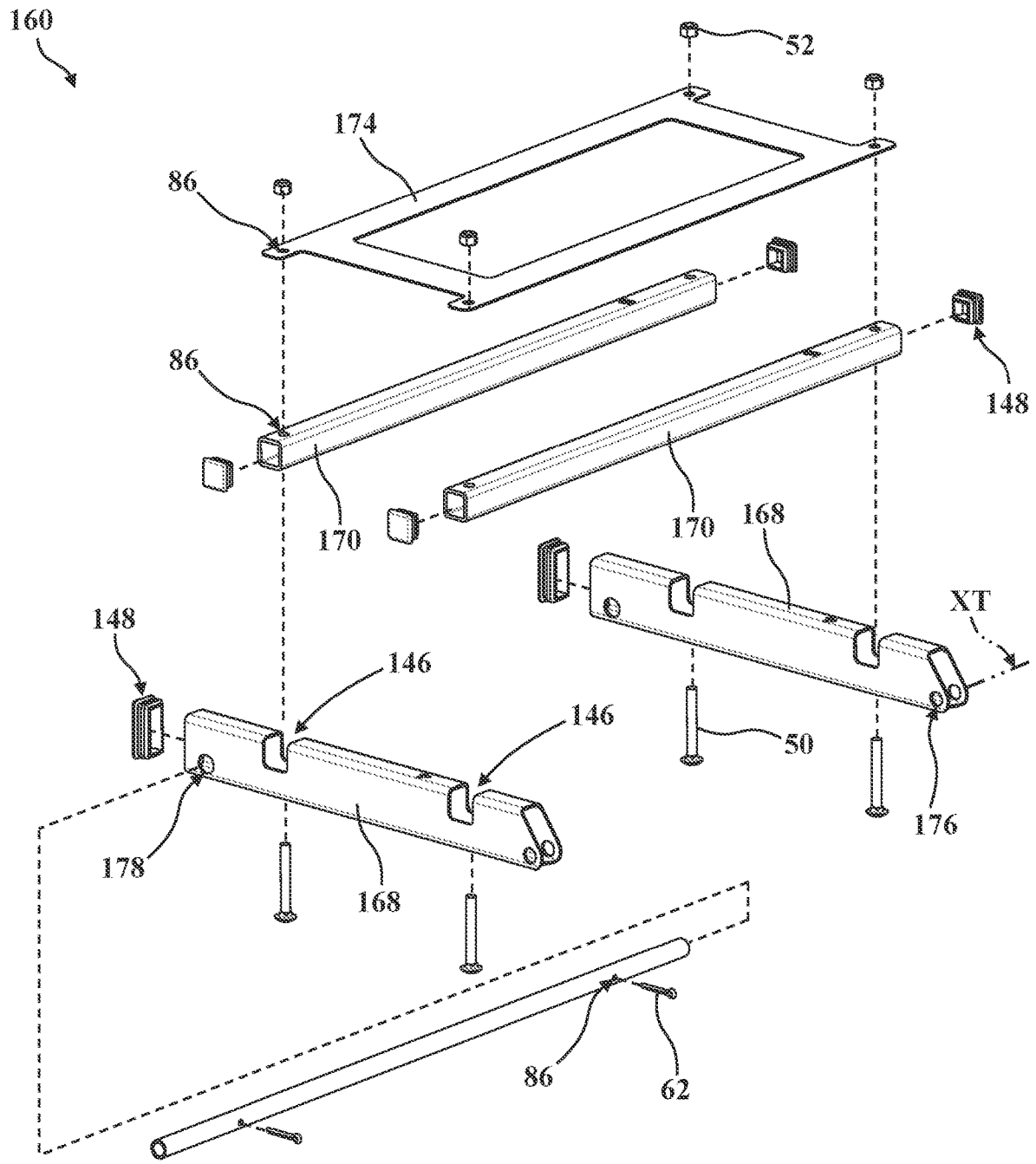
FIG. 8 is an exploded perspective view of the fowler adjuster of FIG. 7.

Referring now to FIG. 8, the fowler adjuster 160 includes a pair of runners 168, a pair of bracers 170, a guide tube 172, and a plate 174. The runners 168 each include upper apertures 176 arranged to receive the clevis pins 56 which pivotably attach to the fowler deck section 40, and lower apertures 178 which receive the guide tube 172. The guide tube 172 is constrained laterally relative to the runners 168 via cotter pins 62 inserted into fastener apertures 86 formed in the guide tube 172. The runners 168 also include open notches 146 shaped to receive and abut against three surfaces of the bracers 170 via contact with four surfaces defined by the open notches 146. Here, the runners 168 are generally rectangular and the bracers 170 have a smaller, generally square-shaped profile. Fasteners (e.g., carriage bolts 50) are employed to facilitate assembling the fowler adjuster 160, and extend through fastener apertures 86 (not shown in detail) formed in the runners 168, the bracers 170, and the plate 174. Caps 148 are inserted into ends of the bracers 170 and one end of the runners 168.

Figure 9:
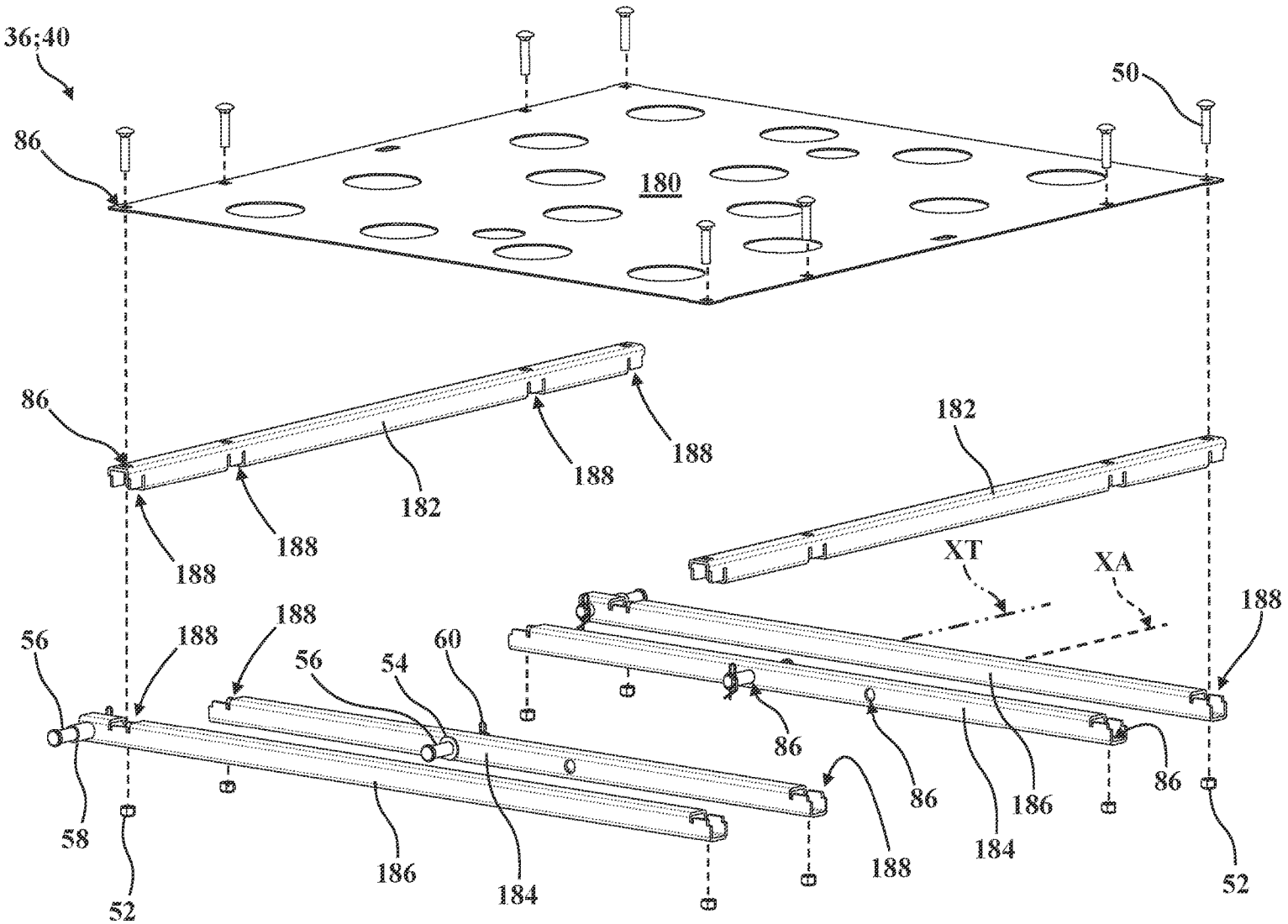
FIG. 9 is a partially-exploded perspective view of the fowler deck section of FIG. 7.

Referring now to FIG. 9, the fowler deck section 40 includes a fowler deck skin 180, a pair of lateral fowler braces 182, a pair of inner fowler rails 184, and a pair of outer fowler rails 186. The inner fowler rails 184 each have fastener apertures 86 arranged to receive clevis pins 56 to pivotably couple to the fowler adjuster 160 about the tilt axis XT, as well as other fastener apertures 86 arranged to receive clevis pins 56 to pivotably couple to the fowler adjuster 160 about the auxiliary tilt axis XA, which is spaced from the tilt axis XT. Here, and as will be appreciated from the subsequent description below, changing from the tilt axis XT to the auxiliary tilt axis XA will adjust the various patient support configurations (e.g., the raised configuration CR and the intermediate configurations CI) that are defined based on which of the retaining notches 162 of the first and second intermediate rails 164, 166 the guide tube 172 of the fowler adjuster 160 is disposed in. At the ends of the inner fowler rails 184 and of the outer fowler rails 186, tabbed notches 188 are formed which are shaped and arranged to engage and abut against surfaces defined by corresponding tabbed notches 188 formed in the lateral fowler braces 182. While not shown in detail herein, the tabbed notches 188 facilitate abutting contact of more than three surfaces. When the tabbed notches 188 are arranged at the end of one of the inner and outer fowler rails 184, 186 or the lateral fowler braces 182, abutment may occur with contact surfaces in notched engagement. When the tabbed notches 188 are spaced from the ends (e.g., as employed at one end of the outer fowler rails 186), abutment may occur with contact surfaces in notched engagement. Here too, notched engagement is secured via fasteners (e.g., carriage bolts 50) extending through fastener apertures 86 arranged adjacent to the tabbed notches 188. While the lateral fowler braces 182 and the inner and outer fowler rails 184, 186 each have a rectangular, generally square-shaped profile, it will be appreciated that other configurations are contemplated.

Figure 13:
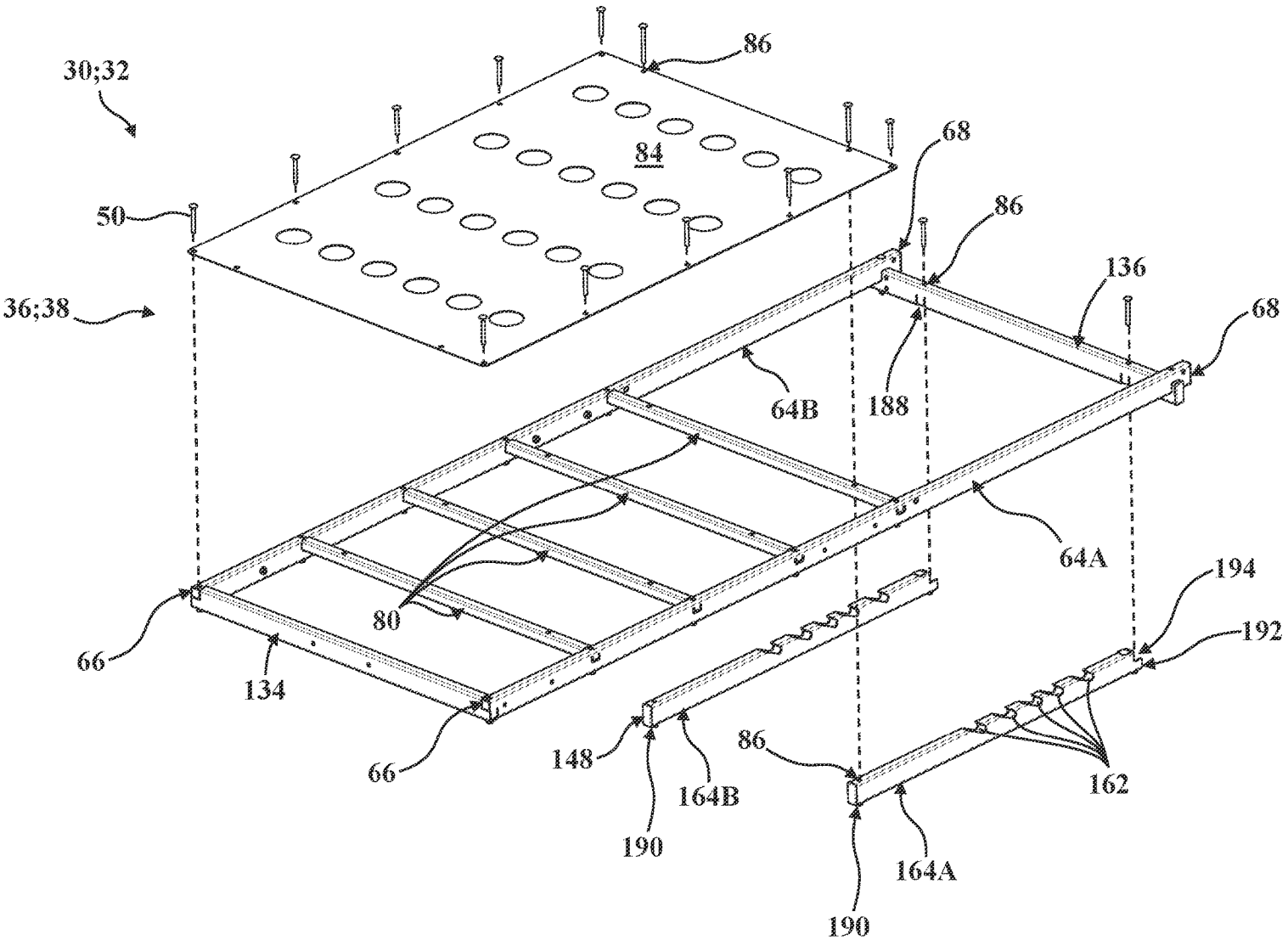
FIG. 13 is a partially-exploded perspective view of portions of the patient support apparatus of FIG. 12, shown with a base deck skin, intermediate rails, and fasteners spaced from other portions of the patient support apparatus.
Figure 14:
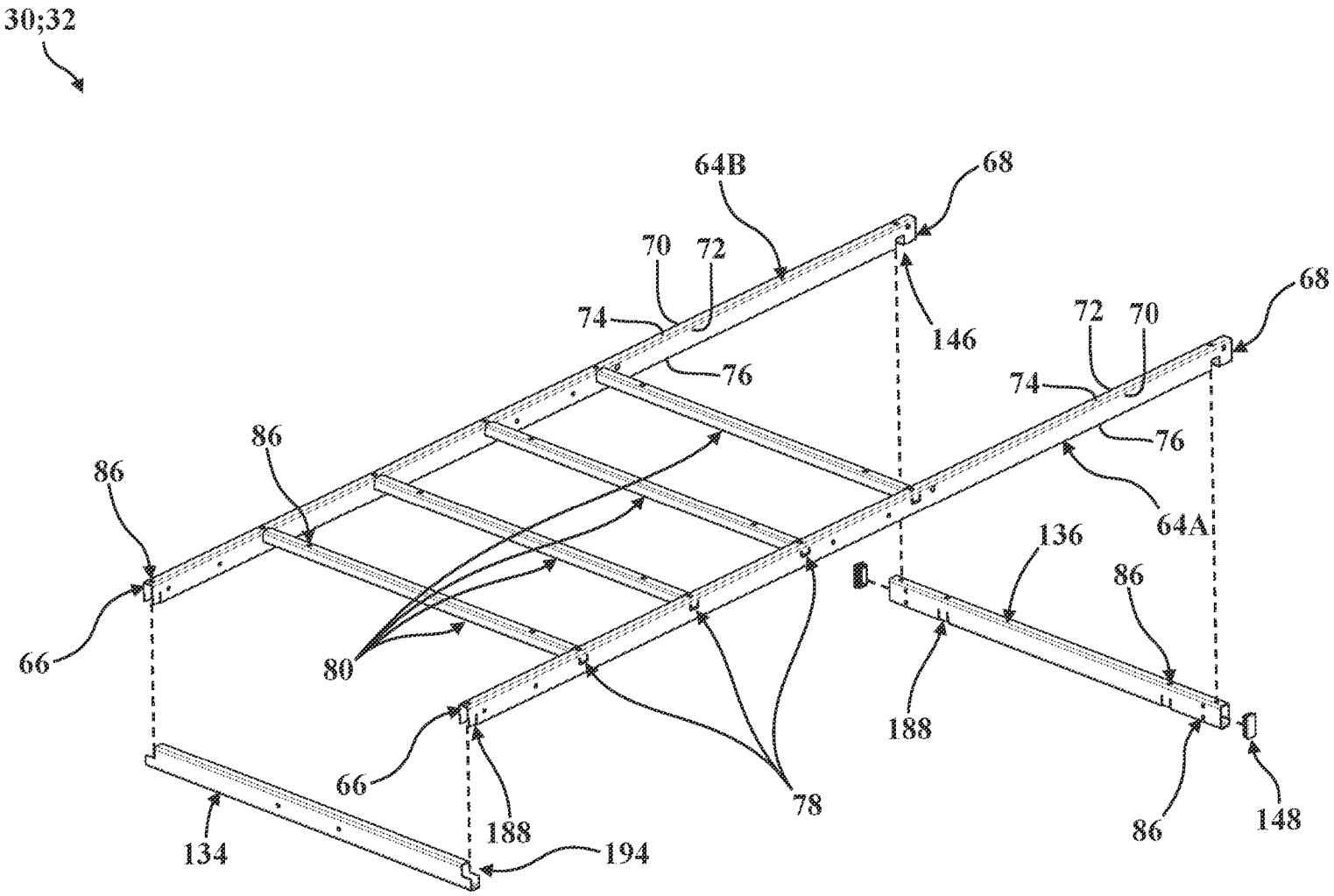
FIG. 14 is a partially-exploded perspective view of portions of the patient support apparatus of FIG. 13, shown with a foot-end rail, a head-end rail, and caps spaced from other portions of the patient support apparatus.

Referring now to FIGS. 12-14, the first and second intermediate rails 164, 166 are secured to the base frame 34 via fasteners (e.g., carriage bolts 50) extending through fastener apertures 86 formed adjacent to the longitudinal ends of the first and second intermediate rails 164, 166. Like other components of the support structure 32, the first and second intermediate rails 164, 166 may be secured via notched engagement and/or abutting contact. In the illustrated embodiment, the first and second intermediate rails 164, 166 each extend between respective distal intermediate ends 190 and proximal intermediate ends 192 (see FIG. 13); adjacent to the distal intermediate ends 190, the first and second intermediate rails 164, 166 are disposed in abutment with the lower brace surface 94 of one of the lateral braces 80, while the proximal intermediate ends 192 are disposed in notched engagement with the head-end rail 136. Here, corner notches 194 are formed adjacent to the proximal intermediate ends 192 of each of the first and second intermediate rails 164, 166 (see also FIG. 22) that are arranged to be disposed in notched engagement with tabbed notches 188 formed in the head-end rail 136 (see also FIG. 23). Like the other notched engagements described above, fasteners (e.g., carriage bolts 50) can be inserted into fastener apertures 86 formed in the head-end rail 136 and the first and second intermediate rails 164, 166 to secure the corner notches 194 in abutment with the tabbed notches 188. Here too, fasteners (e.g., carriage bolts 50) can be inserted into fastener apertures 86 formed in the first and second intermediate rails 164, 166, one of the lateral braces 80, and the base deck skin 84 to secure the abutment between the first and second intermediate rails 164, 166 and the lateral brace 80.

As noted above, retaining notches 162 are formed in the first and second intermediate rails 164, 166. The retaining notches 162 are disposed in spaced relation from each other in the longitudinal direction, and are each shaped to receive the guide tube 172 of the fowler adjuster 160 to define one of the patient support configurations (e.g., the raised configuration CR, an intermediate configuration CI, or the flat configuration CF). It will be appreciated that various quantities and arrangements of retaining notches 162 are contemplated herein.

Referring now to FIGS. 13-14 and 20-22, as noted above, the foot-end rail 134 and the head-end rail 136 are each disposed in notched (and fastened) engagement with the first and second longitudinal rails 64A, 64B. The foot-end rail 134 is disposed in "double sided" notched engagement with the distal rail ends 66 of each of the longitudinal rails 64A, 64B, via corner notches 194 formed at the lateral ends of the foot-end rail 134 (see FIGS. 14 and 22) and via tabbed notches 188 formed at the distal ends 66 of the longitudinal rails 64A, 64B (see FIGS. 14 and 20). Here too, fasteners (e.g., carriage bolts 50) can be inserted into fastener apertures 86 formed in the foot-end rail 134 and the first and second longitudinal rails 64A, 64B to secure the corner notches 194 in abutment with the tabbed notches 188. The head-end rail 136 is disposed in "single sided" notched engagement with the first and second longitudinal rails 64A, 64B adjacent to the proximal rail ends 68, via open notches 146 formed in the first and second longitudinal rails 64A, 64B. Here too, fasteners (e.g., carriage bolts 50) can be inserted into fastener apertures 86 formed in the head-end rail 136 and the first and second longitudinal rails 64A, 64B to secure the open notches 146 in abutment with outer surfaces of the head-end rail 136.

Referring now to FIG. 3, in the illustrated embodiment, the fowler deck section 40 defines a fowler deck width 196 that is smaller than the base deck width 110. Here too, the first and second longitudinal rails 64A, 64B define a lateral rail distance 198 extending between the inner rail surfaces 72, and the lateral rail distance 198 is larger than the fowler deck width 196. This arrangement defines clearance gaps 200 laterally between the fowler deck section 40 and each of the first and second longitudinal rails 64A, 64B. The clearance gaps 200 help promote caregiver access to the fowler deck section 40 (e.g., to adjust the patient support configuration via the fowler adjuster 160) and help minimize pinch points.

In some embodiments, one or more of the components of the patient support apparatus 30 may be provided with indicia (not shown in detail), realized such as by laser cutting, engraving, stamping, or otherwise marking the bottom or other surfaces of the components. Here, it will be appreciated that indicia can be utilized to differentiate different components from each other (e.g., labeling one component as "A" and another component as "B") which can be useful to, among other things, facilitate expedited assembly and coordination with assembly instructions. Other configurations are contemplated.

In this way, the embodiments of the patient support apparatus 30 of the present disclosure can be manufactured, shipped, assembled, and utilized quickly, efficiently, and cost-effectively. Those having ordinary skill in the art will appreciate that the components of the patient support apparatus 30 of the present disclosure can be manufactured using conventional manufacturing equipment (e.g., a laser cutting machine), can be packaged or otherwise shipped in a volume that is significantly smaller than the shipping volume of an assembled patient support apparatus 30, and can be assembled using basic hand tools (e.g., wrenches, pliers, and the like).

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a base frame arranged for movement about a floor surface and defining a foot end and a head end, the base frame including first and second longitudinal rails extending between the foot end and the head end with a plurality of lateral receivers formed in each of the first and second longitudinal rails, wherein the first and second longitudinal rails each comprise:

an outer rail surface and an inner rail surface, with each of the plurality of lateral receivers defined extending through the outer rail surface and through the inner rail surface, an upper rail surface and a lower rail surface, with each of the plurality of lateral receivers spaced vertically between the upper rail surface and the lower rail surface, and a plurality of fastener apertures defined in the upper rail surface and in the lower rail surface;

a patient support deck to provide support to a patient, the patient support deck including:

a fowler deck section coupled to the base frame for pivoting movement relative to the first and second longitudinal rails, and a base deck section attached to the first and second longitudinal rails, the base deck section including a plurality of lateral braces having notched ends shaped to be inserted into a respective one the plurality of lateral receivers formed in the first and second longitudinal rails to assemble the patient support apparatus; wherein each of the plurality of lateral braces further comprise fastener apertures arranged adjacent to the notched ends; and a plurality of fasteners to attach the base deck section to the first and second longitudinal rails, with each of the plurality of fasteners passing through one of the fastener apertures defined in the upper rail surface, through one of the fastener apertures formed in the lateral braces, and out of one of the fastener apertures defined in the lower rail surface.

2. The patient support apparatus as set forth in claim 1, wherein the base deck section further includes a base deck skin supported on the first and second longitudinal rails and on the plurality of lateral braces.

3. The patient support apparatus as set forth in claim 2, wherein the base deck skin defines a base deck width and a base deck length; and wherein the base deck length is larger than the base deck width.

4. The patient support apparatus as set forth in claim 3, wherein a base deck aspect ratio of the base deck length to the base deck width is larger than 1.1:1.

5. The patient support apparatus as set forth in claim 4, wherein the base deck aspect ratio is larger than 1.4:1.

6. The patient support apparatus as set forth in claim 3, wherein the base deck skin is spaced from the floor surface at a fixed base deck height; and wherein half the base deck length is larger than the fixed base deck height.

7. The patient support apparatus as set forth in claim 1, wherein each of the plurality of lateral receivers has a generally U-shaped profile.

8. The patient support apparatus as set forth in claim 1, wherein each of the plurality of lateral braces has a generally rectangular profile.

9. The patient support apparatus as set forth in claim 1, wherein each of the plurality of lateral braces have an upper brace surface and a lower brace surface, a pair of opposing lateral brace end faces, a pair of lateral notch faces defined by the notched ends, and vertical notch faces defined by the notched ends.

10. The patient support apparatus as set forth in claim 9, wherein the vertical notch faces are arranged generally perpendicular to the lateral notch faces.

11. The patient support apparatus as set forth in claim 10, wherein a notch length is defined by the notched ends extending between the opposing lateral brace end faces and the lateral notch faces adjacent thereto;

wherein a notch height is defined by the notched ends extending between the upper brace surface and the vertical notch faces; and wherein the notch length is larger than the notch height.

12. The patient support apparatus as set forth in claim 1, further comprising first and second uprights coupled to the base frame adjacent to the foot end and extending between respective upper and lower upright ends; and a push bar operatively attached to the first and second uprights adjacent to the upper upright ends, with the push bar arranged for engagement by a caregiver to facilitate movement of the patient support apparatus about the floor surface.

13. The patient support apparatus as set forth in claim 12, further comprising caster wheels operatively attached to the base frame to promote movement of the patient support apparatus about the floor surface; and wherein caster wheels are operatively attached to the lower upright ends of each of the first and second uprights.

14. The patient support apparatus as set forth in claim 12, wherein the first and second uprights are respectively disposed in abutment with the first and second longitudinal rails; and further comprising a first gusset plate coupled between the first upright and the first longitudinal rail, and a second gusset plate coupled between the second upright and the second longitudinal rail.

15. The patient support apparatus as set forth in claim 12, wherein the base deck section further includes a base deck skin supported on the first and second longitudinal rails and on the plurality of lateral braces;

wherein the base deck skin is spaced from the floor surface at a fixed base deck height;

wherein the push bar is spaced from the floor surface at a fixed push bar height; and wherein a push bar ratio of the fixed push bar height to the fixed base deck height is larger than 2.0:1.

16. A patient support apparatus comprising:

a base frame arranged for movement about a floor surface and defining a foot end and a head end, the base frame including first and second longitudinal rails extending between the foot end and the head end with a plurality of lateral receivers formed in each of the first and second longitudinal rails; and a patient support deck to provide support to a patient, the patient support deck including:

a fowler deck section coupled to the base frame for pivoting movement relative to the first and second longitudinal rails, and a base deck section attached to the first and second longitudinal rails, the base deck section including a plurality of lateral braces having notched ends shaped to be inserted into a respective one the plurality of lateral receivers formed in the first and second longitudinal rails to assemble the patient support apparatus, wherein each of the plurality of lateral braces have:

an upper brace surface and a lower brace surface, a pair of opposing lateral brace end faces, a pair of lateral notch faces defined by the notched ends, and vertical notch faces defined by the notched ends arranged generally perpendicular to the lateral notch faces;

wherein a notch length is defined by the notched ends extending between the opposing lateral brace end faces and the lateral notch faces adjacent thereto;

wherein a notch height is defined by the notched ends extending between the upper brace surface and the vertical notch faces; and wherein the notch length is larger than the notch height.

* * * * *